US007856907B2

(12) United States Patent
Johnson et al.

(10) Patent No.: US 7,856,907 B2
(45) **Date of Patent: *Dec. 28, 2010**

(54) CUSTOMIZABLE LIGHT BULB CHANGER

(75) Inventors: Ronald L. Johnson, San Jose, CA (US); Robert J. Gallegos, Fremont, CA (US); Steven Simas Escobar, San Jose, CA (US); Anders Scot Hudson, Campbell, CA (US); Idriss Mansouri-Chafik Ruiz, San Jose, CA (US); Yugen Patrick Lockhart, Palo Alto, CA (US); Howard Allen Wilson, Santa Clara, CA (US); Eric M. Colton, Torrance, CA (US)

(73) Assignee: Wagic, Inc., Los Gatos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/618,611

(22) Filed: Nov. 13, 2009

(65) Prior Publication Data

US 2010/0050816 A1 Mar. 4, 2010

Related U.S. Application Data

(63) Continuation of application No. 11/893,021, filed on Aug. 13, 2007, now Pat. No. 7,631,579, which is a continuation-in-part of application No. 11/345,710, filed on Feb. 1, 2006, now Pat. No. 7,255,024, which is a continuation-in-part of application No. 10/841,286, filed on May 7, 2004, now Pat. No. 7,143,668, which is a continuation-in-part of application No. 10/823,522, filed on Apr. 12, 2004, now Pat. No. 6,941,841, which is a continuation-in-part of application No. 10/218,404, filed on Aug. 12, 2002, now Pat. No. 6,739,220.

(51) Int. Cl.
*B25B 23/16* (2006.01)

(52) U.S. Cl. ..... 81/53.12; 81/53.1

(58) Field of Classification Search ..... 81/57.12, 81/53.11, 53.12; 403/1, 109.8, 245, 252, 403/348, 353; 294/19.1
See application file for complete search history.

(56) References Cited

U.S. PATENT DOCUMENTS 548,537 A 10/1895 Green (Continued)

FOREIGN PATENT DOCUMENTS

CN 90226503.2 U 3/1992

(Continued)

*Primary Examiner*—David B Thomas
(74) *Attorney, Agent, or Firm*—Haverstock & Owens LLP

(57) ABSTRACT

A light bulb changing tool comprising a holding structure configured to engage a light bulb, the holding structure configured along an axis, the motorized holding structure configured to actuate in a first direction and a second direction. The light bulb changing tool further includes a force generator configured to selectively force the light bulb against the holding structure and a control unit configured to remotely communicate with the holding structure and the force generator, wherein the electronic control unit sends control signals to drive the holding structure to selectively move in the first direction and the second direction and/or to activate the force generator. The tool further comprises an arm member for positioning the holding structure in a desired configuration to engage the light bulb, wherein the arm member is coupled to the holding structure. The holding structure further comprises a rotator mechanism configured to rotate the holding structure in the first direction about the axis.

33 Claims, 24 Drawing Sheets

U.S. PATENT DOCUMENTS

| | | | |
|---|---|---|---|
| 558,573 | A | 4/1896 | Smith |
| 578,394 | A | 3/1897 | Dunn et al. |
| 609,421 | A | 8/1898 | Edwards |
| 623,180 | A | 4/1899 | Rhine |
| 634,419 | A | 10/1899 | Welden |
| 636,229 | A | 10/1899 | Sims |
| 659,631 | A | 10/1900 | Croteau et al. |
| 673,191 | A | 4/1901 | Arthur |
| 675,640 | A | 6/1901 | Renard |
| 750,408 | A | 1/1904 | Speelman |
| 801,902 | A | 10/1905 | Olafson |
| 809,985 | A | 1/1906 | Rundberg |
| 869,836 | A | 10/1907 | Gaynor |
| 895,625 | A | 8/1908 | Gaynor |
| 925,084 | A | 6/1909 | Edgerton |
| 927,908 | A | 7/1909 | Webb |
| 977,158 | A | 11/1910 | Berkstresser |
| 987,562 | A | 3/1911 | Ferguson |
| 1,056,084 | A | 3/1913 | Bates |
| 1,133,613 | A | 3/1915 | Buss et al. |
| 1,171,380 | A | 2/1916 | Arthur |
| 1,193,685 | A | 8/1916 | Harvey |
| 1,201,506 | A | 10/1916 | Rozelle et al. |
| 1,202,432 | A | 10/1916 | Rozelle et al. |
| 1,210,835 | A | 1/1917 | Price |
| 1,223,791 | A | 4/1917 | Jackson |
| 1,258,430 | A | 3/1918 | Morris |
| 1,311,776 | A | 7/1919 | Rodriguez |
| 1,449,358 | A | 3/1923 | Weber |
| 1,488,031 | A | 3/1924 | Bridwood |
| 1,514,814 | A | 11/1924 | Allen |
| 1,540,143 | A | 6/1925 | Pierpoint |
| 1,541,839 | A | 6/1925 | Metzler et al. |
| 1,655,979 | A | 1/1928 | Watkins |
| 1,787,670 | A | 1/1931 | Clarkson |
| 1,823,170 | A | 9/1931 | Schulz |
| 1,847,953 | A | 3/1932 | Finesey |
| 2,117,017 | A | 5/1938 | Chadsey |
| 2,157,563 | A | 5/1939 | Pethick |
| 2,243,106 | A | 5/1941 | Limbert |
| 2,357,104 | A | 8/1944 | Grinnell |
| 2,357,105 | A | 8/1944 | Grinnell |
| 2,387,846 | A | 10/1945 | Hays |
| 2,473,008 | A | 6/1949 | Chadsey |
| 2,545,043 | A | 3/1951 | Odenthal |
| 2,556,701 | A | 6/1951 | Mendoza |
| 2,573,002 | A | 10/1951 | Foster |
| 2,607,620 | A | 8/1952 | Oliveri |
| 2,616,743 | A | 11/1952 | Negley |
| 2,634,998 | A | 4/1953 | Flower |
| 2,637,587 | A | 5/1953 | Robinson |
| 2,669,478 | A | 2/1954 | Bowle |
| 2,722,448 | A | 11/1955 | Popp et al. |
| 2,946,615 | A | 7/1960 | Yawman, Jr. et al. |
| 2,983,541 | A | 5/1961 | Maki |
| 3,549,188 | A | 12/1970 | Cerasoli |
| 3,631,738 | A | 1/1972 | Harper |
| 3,666,311 | A | 5/1972 | McMullin |
| 3,696,694 | A | 10/1972 | Boro |
| 3,731,966 | A | 5/1973 | Nagy |
| 3,776,584 | A | 12/1973 | Van Gerven |
| 3,788,691 | A | 1/1974 | McMullin |
| 3,799,599 | A | 3/1974 | Jordan |
| 4,068,878 | A | 1/1978 | Wilner |
| 4,167,354 | A | 9/1979 | Walker |
| 4,190,839 | A | 2/1980 | Liautaud |
| 4,218,085 | A | 8/1980 | Unger |
| 4,385,849 | A | 5/1983 | Crain |
| 4,611,512 | A | 9/1986 | Honda |
| 4,663,996 | A | 5/1987 | Grudgfield et al. |
| 4,719,826 | A | 1/1988 | DuBois |
| 4,730,960 | A | 3/1988 | Lewis et al. |
| D297,499 | S | 9/1988 | Whitney |
| 4,791,835 | A | 12/1988 | Unger et al. |
| 4,844,171 | A | 7/1989 | Russel et al. |
| 4,852,925 | A | 8/1989 | Lodin |
| 4,864,899 | A | 9/1989 | Morse |
| 4,876,929 | A | 10/1989 | Kozak |
| 4,901,606 | A | 2/1990 | Christensen |
| 4,970,921 | A | 11/1990 | Fagan |
| 5,103,695 | A | 4/1992 | Dolle et al. |
| 5,123,311 | A | 6/1992 | Dymek |
| 5,148,723 | A | 9/1992 | Newman, Sr. et al. |
| 5,218,889 | A | 6/1993 | Brockberg |
| 5,317,939 | A | 6/1994 | Marinescu |
| 5,330,243 | A | 7/1994 | Held |
| 5,379,666 | A | 1/1995 | Held |
| 5,385,420 | A | 1/1995 | Newman, Sr. et al. |
| 5,386,744 | A | 2/1995 | Garcia |
| 5,407,293 | A | 4/1995 | Crainich |
| 5,436,526 | A | 7/1995 | Hohaus et al. |
| 5,458,026 | A | 10/1995 | Southard et al. |
| 5,464,407 | A | 11/1995 | McGuire |
| 5,490,438 | A | 2/1996 | Zupo et al. |
| 5,546,291 | A | 8/1996 | Simes |
| 5,553,373 | A | 9/1996 | Sprayberry |
| 5,564,852 | A | 10/1996 | Maxwell et al. |
| 5,572,913 | A | 11/1996 | Nasiell |
| 5,593,196 | A | 1/1997 | Baum et al. |
| 5,609,079 | A | 3/1997 | Hashimoto |
| 5,647,622 | A | 7/1997 | Schectman |
| 5,649,255 | A | 7/1997 | Schieltz |
| 5,692,417 | A | 12/1997 | Irpino |
| 5,697,269 | A | 12/1997 | Tseng |
| 5,730,033 | A | 3/1998 | Mitrowski |
| 5,752,287 | A | 5/1998 | Wheat |
| 5,765,453 | A | 6/1998 | Mims |
| 5,797,918 | A | 8/1998 | McGuire et al. |
| 5,802,692 | A | 9/1998 | Philippe |
| 5,806,903 | A | 9/1998 | George |
| 5,809,850 | A | 9/1998 | Tickner |
| 5,823,073 | A | 10/1998 | Tickner |
| 5,823,700 | A | 10/1998 | Poworoznek |
| 5,941,139 | A | 8/1999 | Vodehnal |
| 6,000,251 | A | 12/1999 | Murray, Jr. et al. |
| 6,223,628 | B1 | 5/2001 | Barron |
| 6,254,303 | B1 | 7/2001 | Falat et al. |
| 6,453,777 | B1 | 9/2002 | Newman et al. |
| 6,553,872 | B1 | 4/2003 | Tse et al. |
| 6,739,220 | B1 | 5/2004 | Johnson et al. |
| 6,883,400 | B2 | 4/2005 | Sugano |
| 6,941,841 | B2 | 9/2005 | Johnson et al. |
| 7,131,352 | B1 | 11/2006 | Saunders |
| 7,143,668 | B2 | 12/2006 | Johnson et al. |
| 7,147,399 | B2 | 12/2006 | Viscount et al. |
| 7,255,024 | B2 | 8/2007 | Johnson et al. |
| 7,334,503 | B1 | 2/2008 | Newman et al. |
| 2004/0025641 | A1 | 2/2004 | Sugano |
| 2005/0178246 | A1 | 8/2005 | Johnson et al. |

FOREIGN PATENT DOCUMENTS

| | | | |
|---|---|---|---|
| DE | 217665 | A1 | 1/1985 |
| GB | 2198383 | A | 6/1988 |
| JP | 52-90382 | | 7/1977 |
| JP | 61033371 | A | 2/1986 |
| JP | 61-62355 | | 4/1986 |
| JP | 62-175655 | | 11/1987 |
| JP | 64-35658 | | 3/1989 |
| JP | 2-25160 | | 2/1990 |
| JP | 2000-308977 | | 11/2000 |

CUSTOMIZABLE LIGHT BULB CHANGER

RELATED APPLICATIONS

This Application is a continuation of U.S. patent application Ser. No. 11/893,021, filed on Aug. 13, 2007, and entitled "CUSTOMIZABLE LIGHT BULB CHANGER," which is a continuation-in-part of U.S. patent application Ser. No. 11/345,710 filed on Feb. 1, 2006 and entitled "CUSTOMIZABLE LIGHT BULB CHANGER WITH SUCTION CUP AND CONTROL," which is a continuation-in-part of U.S. patent application Ser. No. 10/841,286 filed on May 7, 2004 and entitled "CUSTOMIZABLE LIGHT BULB CHANGER", which is a continuation-in-part of U.S. patent application Ser. No. 10/823,522 filed on Apr. 12, 2004 which is a continuation of U.S. application Ser. No. 10/218,404 filed on Aug. 12, 2002, titled "MOTORIZED LIGHT BULB CHANGER", which are all hereby incorporated by reference.

FIELD OF THE INVENTION

The present invention relates to a remote access tool. More specifically, the present invention relates to a customizable light bulb changer designed to remove and replace light bulbs of various sizes, shapes, and configurations which are held at a variety of angles and heights and are otherwise inaccessible from ground level.

BACKGROUND OF THE INVENTION

Numerous light bulb removal tools have been patented which alleviate the problems associated with replacing light bulbs from remote locations. One such problem is accessibility. Overhead lights are purposefully positioned out of reach to minimize risks associated with heat burns and unintentional contact which could result in globe glass breakage; furthermore, many lights are recessed within their fixtures, limiting physical access to only a small portion of the bulb. Another problem stems from the variety of angles from which bulbs must be extracted and replaced from these remote locations, such as from chandeliers and hanging light arrangements. Another problem is the adjustability of the handle to reach light bulbs at varying distances. Other problems arise from the need to apply force to the bulb and lighting fixture: too much force can cause damage to the bulb or fixture, or even bodily injury.

U.S. Pat. No. 1,514,814 to Allen, discloses an electric bulb holder which has bulb gripping arms that are pivotally connected to a slidable member which causes the bulb gripping arms to spread around the light bulb and then collapse to grip the light bulb. Once the user has a grip of the light bulb, she must rotate the whole bulb holder to screw or unscrew the light bulb. Further, the handle in this patent does not have a flexible arm for reaching light bulbs that are at an angle.

U.S. Pat. No. 2,983,541 to Maki discloses a device for removing or placing light bulbs in sockets. Specifically, the device taught by Maki consists of a fixed rod with a bendable arm for reaching light bulbs at different angles. The patent discloses using a helicoidal operating member inside the bendable arm which is bendable and rotatable. However, the device taught by Maki, by having a fixed rod, does not allow the user to adjust the rod to different heights. Also, the user must use an air bulb to create suction in an engaging cup to engage the light bulb. This is disadvantageous to the user, because the cup is not adjustable to engage different sized light bulbs.

U.S. Pat. No. 2,616,743 to Negley discloses a light bulb changer having a rigid handle and a bendable arm attached to the handle. Although this light bulb changer allows the user to bend the arm to engage light bulbs at different angles, the light bulb changer does not allow the user to adjust the handle to different heights. Further, the light bulb changer taught by Negley does not allow the user to adjust the mechanism to fit differently sized light bulbs.

U.S. Pat. Nos. 1,202,432 and 1,201,506 to Rozelle et al., both disclose an adjustable device for placing and removing electric light bulbs. Specifically, the device taught in these patents utilizes a rod which has a pivoting section about a clamp screw for reaching light bulbs at different angles. However, the pivoting section is locked by tightening the clamp screw, which is burdensome on the user, because the user must use a screw driver, or some other external tool, to lock the pivoting shaft. Further, the rods taught in this patent are also adjustable to reach light bulbs at different heights, but the mechanism to lock the rods at a desired height is limiting. The mechanism to prevent the sliding of the rods consists of pins positioned along the rod which are configured to slide into a bayonet slot cut into the outer surface of the rod. Therefore, the user can only adjust the rod at certain heights, which is burdensome if the light bulb is at a height that does not correspond to any of the positions available on the rod.

SUMMARY OF THE INVENTION

In an embodiment, the present invention presents a light bulb changing tool which comprises a movable holding cup configured along an axis and configured to engage a light bulb, a force generator, configured to selectively force the light bulb against the movable holding cup, a control unit configured to control the movable holding cup to selectively rotate in a first direction and a second direction around the axis, and configured to activate the force generator to force the light bulb against the movable holding cup, and an arm member for positioning the movable holding cup in a desired configuration to engage the light bulb, the arm member coupled to the movable holding cup. In an embodiment of the present invention, the holding cup is small enough, and the force generator sufficiently powerful, to permit manipulation of light bulbs of which only a portion are exposed. Such light bulbs include, but are not limited to, those configured within recessed lighting fixtures, and outdoor flood lights with shrouds.

In a further aspect, the present invention describes an improvement to a light bulb changing tool, wherein the improvement comprises an adjustable holding cup coupled with the clasping mechanism having an adjustable dimension configurable to engage a correspondingly sized light bulb, and a force generator, configured to engage the light bulb by forcing the light bulb against the adjustable holding cup.

In some embodiments, the present invention is adapted to permit a user to easily switch the clasping mechanism, holding cup, or other means for holding to permit use of multiple attachments with a single changing tool body.

In another embodiment, the present invention presents a light bulb changing tool for selectively tightening and loosening a light bulb. The light bulb changing tool includes means for holding the light bulb, a means for forcing the correspondingly sized light bulb to a held position against the holding means, and means for coupling, the coupling means configured to detachably couple to an arm member, wherein the arm member is configured for positioning the light bulb changing tool in a desired configuration to engage the light bulb. In an additional embodiment, the means for holding comprises a means for size adjusting, the size adjusting means configured to adjust the holding means to an adjustable dimension for engaging a correspondingly sized light bulb.

In another aspect, the present invention discloses a light bulb changing tool for selectively tightening and loosening a light bulb. The light bulb changing tool comprises a holding structure, configured to hold the light bulb, a force generator actuable to force the light bulb to a held position against the holding structure, and a controller configured to selectively actuate the force generator to force the light bulb to the held position or release the light bulb from the held position.

In yet another aspect, the present invention presents a motorized clasping mechanism for changing a light bulb. The motorized clasping mechanism includes a clasping mechanism housing, and an arm member coupled to the clasping mechanism housing and adapted to couple to a tubular member and configured to position the clasping mechanism housing in a desired configuration, wherein at least a portion of the arm member is independently moveable with respect to another portion of the arm member. The clasping mechanism housing includes an adjustable holding structure configured along an axis, a motor coupled to the holding structure, and a force generator coupled with the adjustable holding structure and configured to selectively force a light bulb against the holding structure in response to an appropriate force signal from the remotely located control source. The holding structure includes a plurality of fingers and a plurality of resilient panels configured between the plurality of fingers. Further, the motor is configured to selectively actuate the plurality of fingers in a desired direction about the axis in response to an appropriate movement signal from a remotely located control source.

In an additional embodiment, the present invention presents another light bulb changing tool. In this aspect, the light bulb changing tool includes a movable holding cup configured along an axis, a force generator, configured to selectively force the light bulb against the movable holding cup, an electronic control unit configured for remote communication with the movable holding cup and the force generator, wherein the electronic control unit sends control communications to drive the movable holding cup to selectively rotate in a first direction and a second direction around the axis and/or to activate the force generator to force the light bulb against the movable holding cup, and an arm member for positioning the movable holding cup in a desired configuration to engage the light bulb, the arm member coupled to the movable holding cup and adapted to be coupled to a tubular member, wherein at least a portion of the arm member is laterally moveable with respect to the tubular member.

Further, in some embodiments, the movable holding cup includes a torque limiter which limits the rotational force which the movable holding cup can apply to a light bulb. In an alternative aspect, the light bulb changer includes a detection circuit configured to detect when a light bulb has been fully inserted into a socket. The detection circuit is configured to signal the movable holding cup to stop rotation when the light bulb is fully inserted.

In one aspect of this embodiment, the moveable holding cup is mechanically rotated and the control communications that drive the moveable hold cup are mechanical signals. These mechanical signals can be manually generated or electrically generated. In an alternative aspect, the moveable holding cup is motorized, and the control communications that drive the moveable holding cup to selectively rotate are electrical signals. Similarly, the control communications that activate the force generator can comprise several different types. In one aspect, they can be electrical signals. In an alternative aspect, they can be mechanical signals.

In some embodiments, the control communications are sent wirelessly from the electronic control unit to the movable holding cup and to the force generator. In an alternative embodiment an electronic control unit and one or more of the movable holding cup and the force generator are coupled to one another by a cable and the tool includes a clip that secures the cable to the tubular member. The movable holding cup, the force generator, and the electronic control unit are coupled to a tubular member in some embodiments. In some embodiments, the electronic control unit is powered by a DC voltage source and alternatively by an AC voltage source.

In an alternative embodiment, the holding cup is adjustable. An exemplary adjustable holding cup includes a set of interconnected leaves adjustable by a telescoping collar. The telescoping collar further can include an interconnect configured to detachably couple to the arm member. In another aspect, the telescoping collar can include a turn knob and a plurality of marks corresponding to settings for specific light-bulb sizes.

In some embodiments the control unit is provided in a separate device from the light bulb changing tool, while in other embodiments the control unit is coupled to the light bulb changing tool. Further, though the exemplary embodiments discussed above include one control unit capable of remote communications, in an embodiment a second, local control unit is configured to control the force generator. Alternatively, the local control unit is configured to control the moveable holding cup as well. Further, the local control unit is coupled with the arm member in some embodiments.

In one aspect of the present invention is a tool for selectively tightening and loosening a light bulb. The tool comprises means for clasping the light bulb. The clasping means is configured to have an adjustable dimension that is for clasping a correspondingly sized light bulb. The tool includes means for activating the clasping means. The activating means is configured for remote communication with the clasping means, wherein the activating means sends control communications to move the clasping means in a first direction and a second direction. The tool further comprises means for setting the clasping means in a desired configuration to engage the light bulb. The setting means is coupled to the clasping means. The setting means further comprises a means for varying the adjustable dimension. The varying means is coupled to the activating means. The control communications are sent wirelessly from the activating means to the clasping means in some embodiments. In an alternative embodiment, the clasping means and the activating means are coupled to one another by a cable. The clasping means and the activating means are coupled to a tubular member in some embodiments. The tool further comprises means for securing the wire to the tubular member, wherein the overall length of the tubular member is able to be selectively adjusted. In some embodiments, the means for activating is powered by a DC voltage source and alternatively by an AC voltage source.

In another aspect of the invention is a light bulb changing tool that comprises a motorized clasping mechanism that is configured to engage a light bulb. The motorized clasping mechanism is configured along an axis and to actuate in a first direction and a second direction. The tool includes an electronic drive unit that is configured for remote communication with the motorized clasping mechanism. The electronic drive unit sends control communications to drive the motorized clasping mechanism to selectively move in the first direction and the second direction. The tool further comprises an arm member that positions the motorized clasping mechanism in a desired configuration to engage the light bulb. The arm member is coupled to the motorized clasping mechanism. The motorized clasping mechanism further comprises a rotator mechanism that is configured to rotate the motorized clasping mechanism in the first direction about the axis. The motorized clasping mechanism further comprises a plurality of spring urged fingers. The tool further comprises an adjusting mechanism that is configured to actuate the motorized clasping mechanism in the second direction. The control communications are sent wirelessly from the electronic drive unit to the motorized clasping mechanism. The motorized clasping mechanism and the electronic drive unit are alternatively coupled to one another by a cable. In some embodiments, the motorized clasping mechanism and the electronic drive unit are coupled to a tubular member. The tool further comprises a clip that secures the cable to the tubular member. In some embodiments, the electronic drive unit is powered by a DC voltage source and alternatively by an AC voltage source.

In yet another aspect of the invention is a method of assembling a light bulb changing tool. The method comprises the step of providing a clasping mechanism that is configured to engage a light bulb, wherein the clasping mechanism has an adjustable dimension. The method comprises providing a drive unit in remote communication with the clasping mechanism, wherein the drive unit sends control communications to electrically activate the clasping mechanism to actuate the clasping mechanism in a first direction and a second direction. The method further comprises the step of coupling an adjusting arm to the clasping mechanism, whereby the adjusting arm is configured to adjust the clasping mechanism to a desired position that is relative to the light bulb. The method further comprises the step of coupling the clasping mechanism and the drive unit to a tubular member. In some embodiments, the control communications are sent wirelessly from the drive unit to the clasping mechanism. The method further comprises the step of coupling the clasping mechanism and the drive unit to one another by a cable. The method further comprises securing the cable to the tubular member with a clip.

In yet another aspect, an interconnect of a light bulb changer comprises a receiving member including a first aperture and a set of tabs and a securing member detachably coupled to the receiving member, the securing member configured for securing a protruding member with the receiving member. The protruding member protrudes from a holding cup configured to engage a light bulb. The protruding member is configured for insertion into the receiving member. The protruding member further includes a lateral component and a longitudinal component, further wherein the lateral component is configured to be positioned between the set of tabs and the longitudinal component is configured to be positioned within the first aperture. The receiving member is configured for receiving the protruding member. The securing member further includes a second aperture for receiving the protruding member and a structure for securing the protruding member with the receiving member. The interconnect is configured to detachably couple to a holding cup. The interconnect is configured to detachably couple to an arm member. The arm member is configured for positioning the light bulb changer in a desired configuration to engage a light bulb. In some embodiments, the arm member is motorized. In some embodiments, the arm member is non-motorized. The holding cup is utilized with a variety of types of light bulbs wherein the lightbulb is selected from the group comprising recessed type, flood light type, reflector type, regular household type, bent tip decorative type, torpedo shape type, beacon lamp type, track head type, candelabra type, globe type, and compact fixture type lightbulb. The holding cup is a creased gripping member. The holding cup is utilized with a variety of types of light bulbs wherein the lightbulb comprises a bulbous portion and a narrow portion, wherein the narrow portion is narrower than the bulbous portion. The interconnect comprises a non-electrical conducting material. In some embodiments, the non-electrical conducting material comprises plastic. In some embodiments, the non-electrical conducting material comprises polymer. In some embodiments, the non-electrical conducting material comprises elastomer.

In another aspect, a light bulb changer comprises a creased gripping member configured to engage and selectively tighten and loosen a light bulb, the creased gripping member including a plurality of creases and a protruding member, wherein the plurality of creases are configured for expanding and retracting the creased gripping member and an interconnect including a receiving member and a securing member, wherein the protruding member is configured for insertion into the receiving member, the receiving member is configured for receiving the protruding member and the securing member is configured for securing the protruding member with the receiving member. The receiving member further includes a first aperture and a set of tabs. The securing member further includes a second aperture for receiving the protruding member and a structure for securing the protruding member with the receiving member. The protruding member further includes a lateral component and a longitudinal component, further wherein the lateral component is configured to be positioned between the set of tabs and the longitudinal component is configured to be positioned within the first aperture. The interconnect is detachably coupled to the creased gripping member. The interconnect is further configured to detachably couple to an arm member. The arm member is configured for positioning the light bulb changer in a desired configuration to engage the light bulb. In some embodiments, the arm member is motorized. In some embodiments, the arm member is non-motorized. The creased gripping member is utilized with a variety of types of light bulbs wherein the lightbulb is selected from the group comprising recessed type, flood light type, reflector type, regular household type, bent tip decorative type, torpedo shape type, beacon lamp type, track head type, candelabra type, globe type, and compact fixture type lightbulb. The creased gripping member is utilized with a variety of types of light bulbs wherein the lightbulb comprises a bulbous portion and a narrow portion, wherein the narrow portion is narrower than the bulbous portion. The creased gripping member and the interconnect comprise a non-electrical conducting material. In some embodiments, the non-electrical conducting material comprises plastic. In some embodiments, the non-electrical conducting material comprises polymer. In some embodiments, the non-electrical conducting material comprises elastomer.

In yet another aspect, a light bulb changing tool for selectively tightening and loosening a light bulb comprises means for gripping the light bulb, wherein the gripping means includes means for expansion and contraction, the expansion and contraction means configured to expand the gripping means to a second size for engaging a light bulb and contract the gripping means to a first size after disengaging the light bulb and means for coupling, the coupling means configured to detachably couple to an arm member, wherein the arm member is configured for positioning the light bulb changing tool in a desired configuration to engage the light bulb. The means for gripping is utilized with a variety of types of light bulbs wherein the lightbulb is selected from the group comprising recessed type, flood light type, reflector type, regular household type, bent tip decorative type, torpedo shape type, beacon lamp type, track head type, candelabra type, globe type, and compact fixture type lightbulb. The means for expansion and contraction comprise a plurality of creases. The means for gripping the light bulb and the means for coupling comprise a non-electrical conducting material. In some embodiments, the arm member is motorized. In some embodiments, the arm member is non-motorized.

DETAILED DESCRIPTION OF THE INVENTION

Figure 1A:
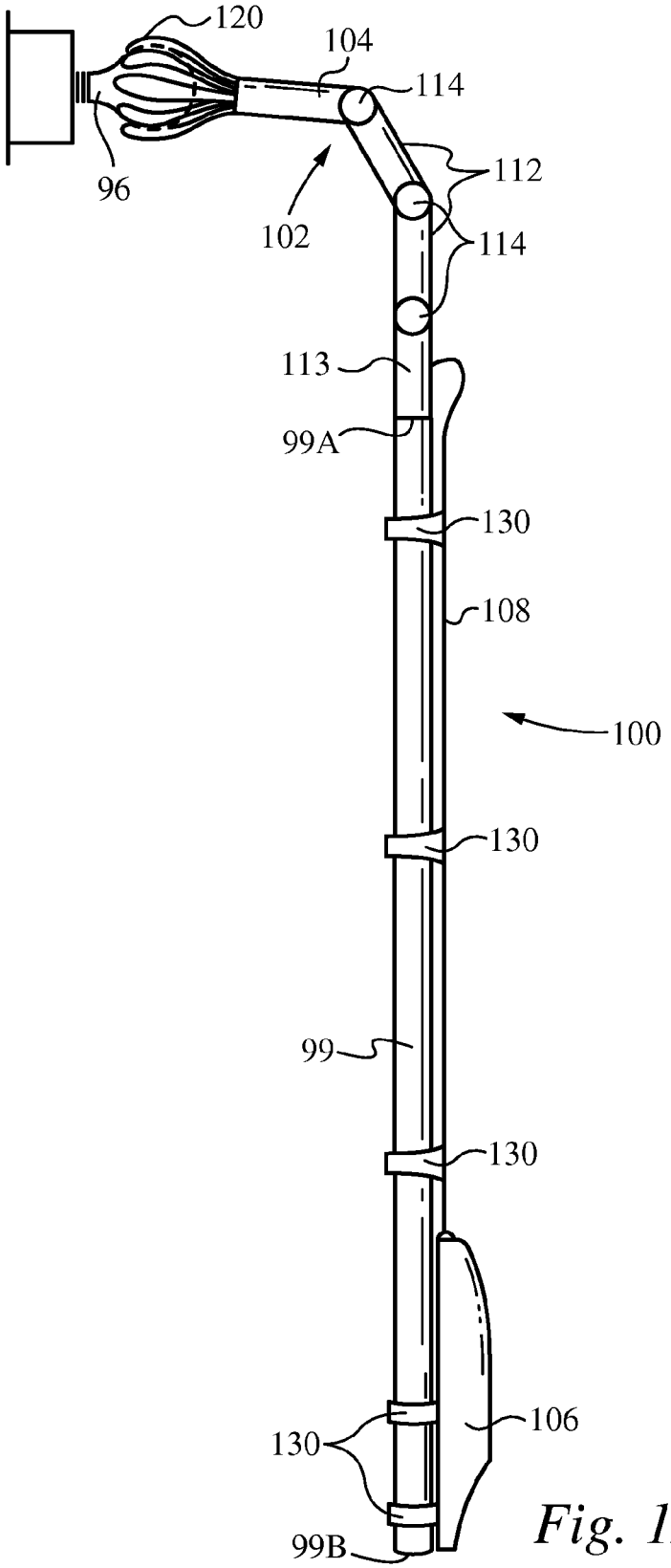
FIG. 1A illustrates a side view of an alternative embodiment of the motorized light bulb changer device with pole, in accordance with the present invention.

FIG. 1A illustrates a side view of an alternative embodiment of the motorized light bulb changer device with pole in accordance with the present invention. Generally, the motorized light bulb changer 100 includes a clasping mechanism 102 having a set of fingers 120, a motor unit 104, an arm unit 112 having a pair of arm members 112A and 112B (FIG. 2) and a connecting arm 113. In addition, the light bulb changer 100 includes a drive or power unit 106, whereby the drive unit 106 is coupled to the clasping mechanism 102 by a cable 108. As will be described in detail below, in the alternative embodiment of the present invention, the drive unit 106 communicates wirelessly to control the self-powered clasping mechanism 102. The motorized light bulb changer 100 shown in FIG. 1A is coupled to a pole 99 which allows the user to change light bulbs 96 held at a variety of angles and heights, that are otherwise inaccessible from ground level. In some embodiments the length of the pole 99 is adjustable, although it is not required. The details of an adjustable pole 99 are described in co-pending U.S. patent application Ser. No. 10/218,474 filed Aug. 12, 2002 entitled, "LIGHT BULB CHANGER" which is hereby incorporated by reference. Any other adjustable pole 99 known in the art is alternatively used in conjunction with the present invention.

Figure 2:
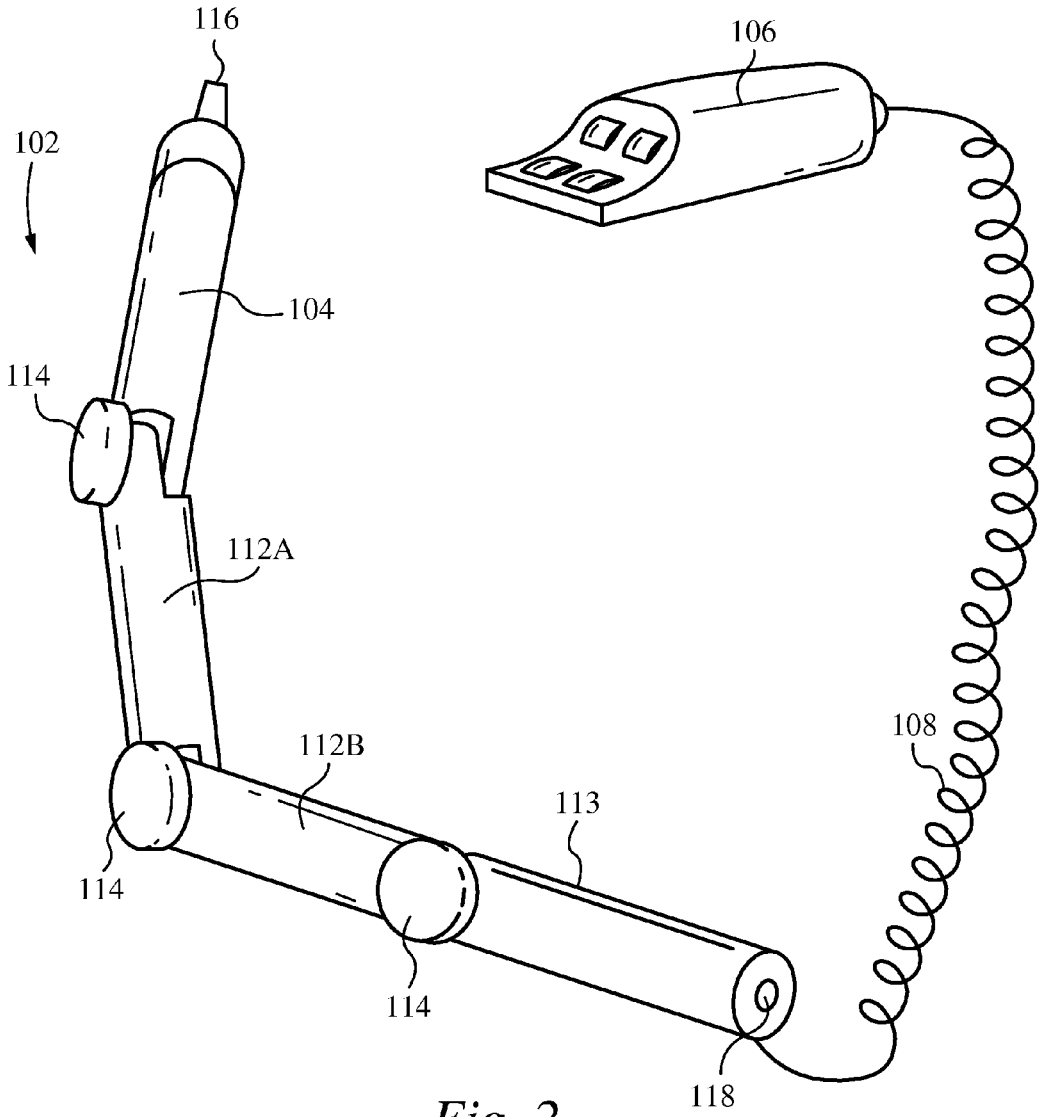
FIG. 2 illustrates a perspective view of an alternative embodiment of the individual components of the motorized light bulb changer, in accordance with the present invention.

FIG. 2 illustrates a perspective view of the alternative embodiment of the individual components of the motorized light bulb changer 100 in accordance with the present invention. FIG. 2 shows the clasping mechanism 102 having the motor unit 104, adapter 116, two arm members 112A and 112B, a connecting arm 113, cable 108 and the drive unit 106. As shown in FIG. 2, a motor unit 104 is coupled to two adjustable arm members or components 112A and 112B. Alternatively, any number of adjustable arm components 112 are coupled to the motor unit 104. The adjustable arm components 112 allow the user to set the clasping mechanism 102 to a desired configuration by being rotatable and moveable with respect to one another.

The motor unit 104 is coupled to the upper arm member 112A. The upper arm member 112A is coupled to the lower arm member 112B. The lower arm member 112B is coupled to the connecting arm 113. In some embodiments, the motor unit 104, the arm members 112A and 112B and the connecting arm 113 are adjustable at any angle with respect to one another by a set of threaded knobs 114. Alternatively, the motor unit 104, the arm members 112A and 112B and the connecting arm 113 are adjustable at any angle with respect to one another by a set of pull and lock knobs. In some embodiments, the upper arm 112A and the lower arm 112B are adjustable with respect to one another when the knobs 114 are pushed or released. In contrast, the motor unit 104 as well as the upper arm 112A and the lower arm 112B are not adjustable when the are in the locked position. Accordingly, the user is able to position the arms 112A and 112B in the desired configuration while the knobs 114 are released and then tighten the knobs 114 to maintain the arms 112A and 112B in that configuration by setting the knobs to the locked position. Alternatively, any other means for tightening and loosening the drive unit 110 as well as the upper arm 112A, the lower arm 112B and connecting arm 113 with respect to one another are used, including but not limited to rotatable loosening and tightening knobs, pins, screws and bolts. The connecting arm 113 shown in FIG. 2 includes an aperture 118 which serves to accept an end 99A of the pole 99. Thus, the clasping mechanism 102 engages the end 99A of the pole 99 which is used to reach the light bulb 96.

Figure 1B:
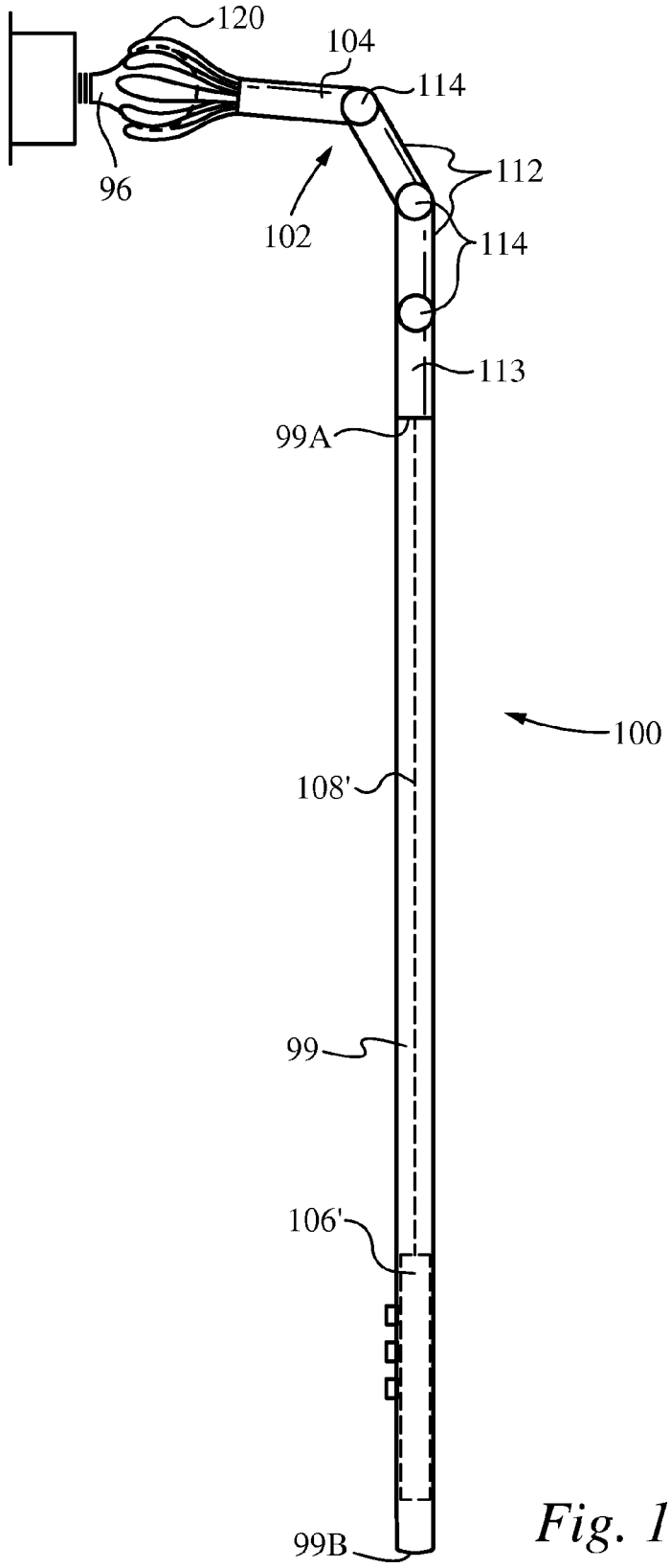
FIG. 1B illustrates a side view of an alternative embodiment of the motorized light bulb changer device with pole, in accordance with the present invention.
Figure 11:
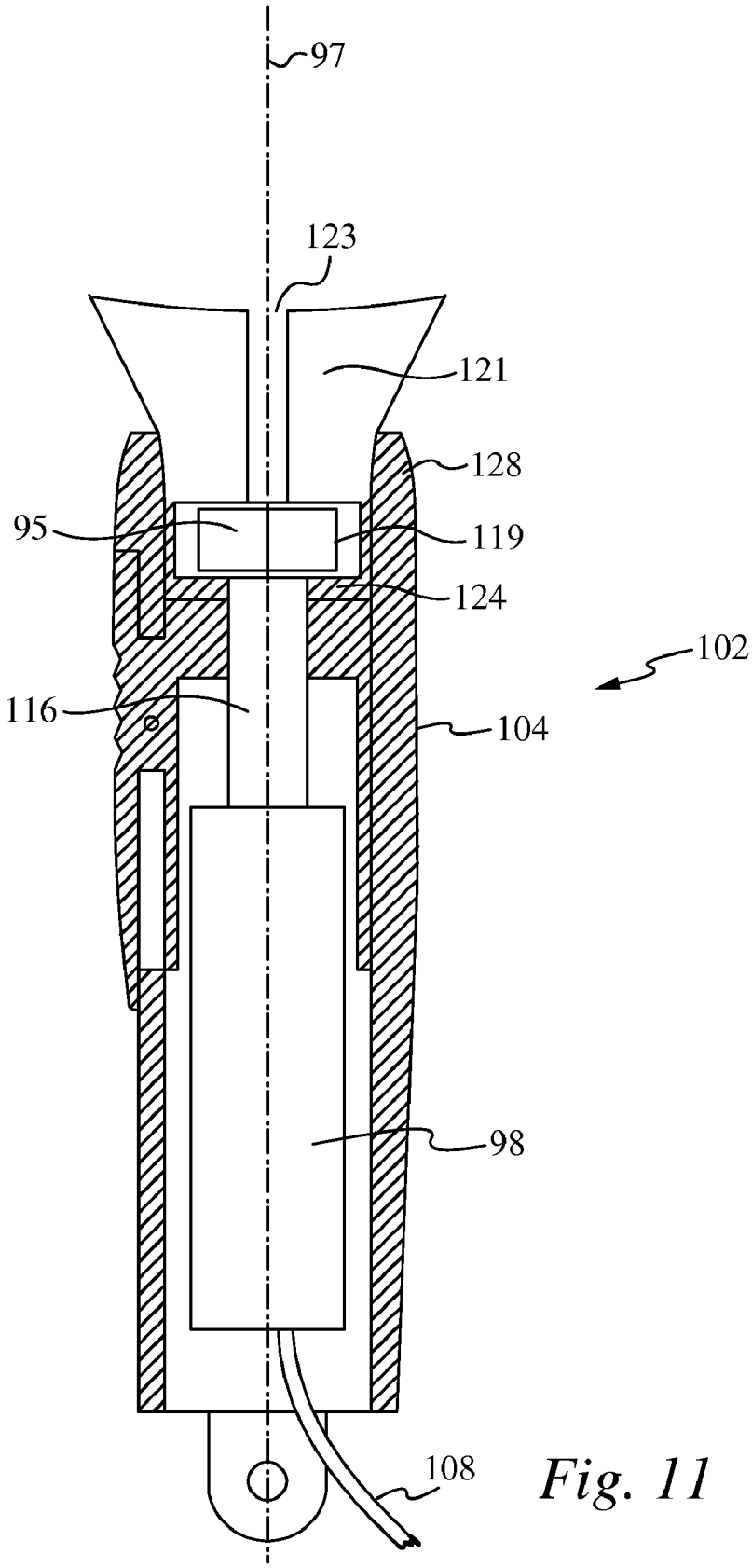
FIG. 11 illustrates a cross sectional view of an alternative embodiment of the clasping mechanism, in accordance with the present invention.
Figure 15A:
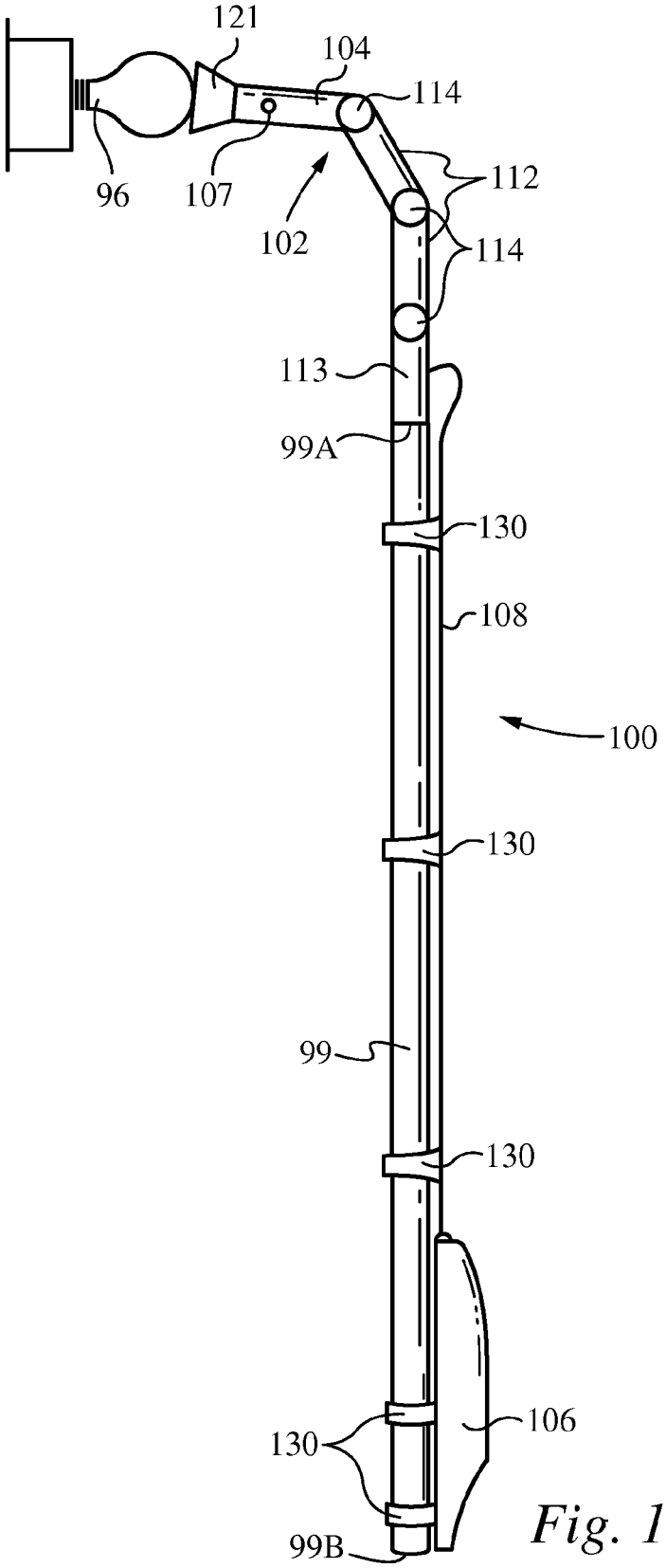
FIG. 15A illustrates a side view of an embodiment of the motorized light bulb changer device with pole, in accordance with the present invention.
Figure 15B:
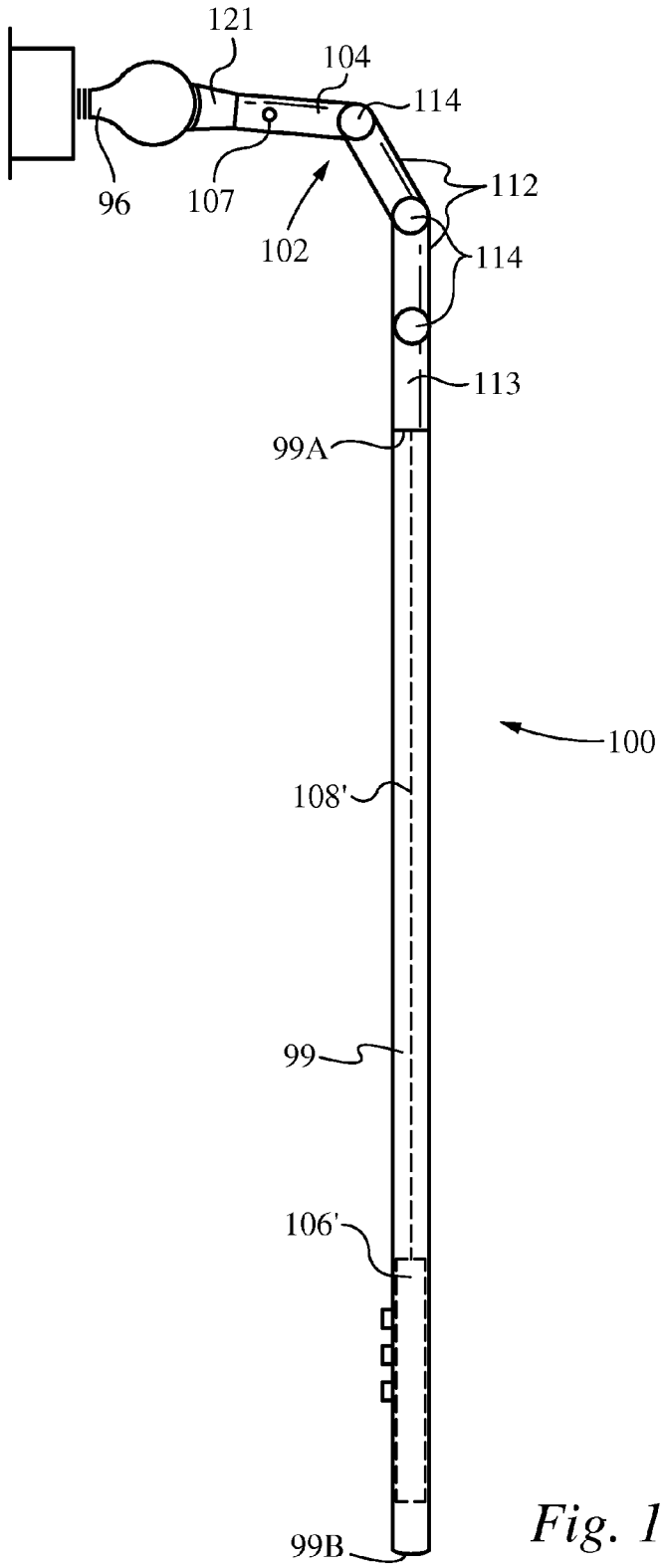
FIG. 15B illustrates a side view of an embodiment of the motorized light bulb changer device with pole, in accordance with the present invention.

In embodiments according to the present invention, the motorized light bulb changer 100 of FIG. 1A or 1B are changed as illustrated in FIG. 15A or 15B to include a holding cup 121 configurable to engage the light bulb 96, and a force generator, e.g. 95 in FIG. 11, configured within the motor unit 104 to engage the light bulb by forcing the light bulb against the adjustable holding cup 121, in some embodiments. In exemplary aspects, the force generator includes a mechanical system for generating suction, an electromechanical system for generating suction, or an electrochemical system for generating suction. In addition, in some embodiments, the force generator also selectively generates positive pressure, for use with alternative types of holding structures. Further, in some embodiments, though the control units 106 and 106' are configured to selectively activate the force generator to force a light bulb against the holding cup, the two light bulb changers 100 also include the auxiliary control switches, 107, which are also configured to control the force generator. Each of these switches selectively activates and deactivates the force generator.

Shown in FIG. 2 is a drive unit 106 coupled to the motor unit 104. The drive unit 106 is coupled at or near the end 99B of the pole 99, which is opposite the end 99A to which the clasping mechanism 102 is coupled, in some embodiments. As shown in FIG. 1A, in some embodiments, the drive unit 106 is coupled to the pole 99 by a set of clips 130, which are discussed below. Alternatively, as shown in FIG. 1B, the drive unit 106' as well as the wire 108' connecting the drive unit 108' to the motor unit 104 is configured to be integrated within the pole 99. The drive unit 106 includes a plurality of buttons which allow the user to drive the clasping means 102. As will be discussed in more detail below, the clasping means 102 rotates about axis 97 (FIG. 3A) and is configured for use with attachments having different dimensions between the oppositely faced fingers 120 (FIG. 3A) to adjust to engage light bulbs 96 of different sizes. The movements as well as the direction of movements of the clasping mechanism 102 are controlled by the drive unit 106. Thus, the drive unit 106 supplies a predetermined voltage and/or current to the motor 98 in the motor unit 104 to cause the clasping mechanism 102 to perform the desired movements. Thus, a circuit (not shown) within the drive unit 106 supplies a predetermined voltage to the motor 98, thereby activating or driving the clasping mechanism 102 to move in a clockwise direction. Similarly, the circuit (not shown) within the drive unit 106 supplies another predetermined voltage to the motor 98, thereby driving the clasping mechanism 102 to move in a counter-clockwise direction. The drive unit 106 is powered by a DC voltage, such as batteries. Alternatively, the drive unit 106 is powered by an AC voltage, such as plugging into a wall socket. The drive circuit 106 also provides power to enable the operation of the motor 98 through the cable 108. As will be discussed in detail below, in the alternative embodiment of the present invention, the power source for the motor 98 is resident within the connecting arm 113.

Shown in FIG. 2 is a cable 108 present between the lower arm member 112B and the drive unit 106. The cable 108, although shown in FIG. 2 going into the lower arm member 112B, couples to the motor 98 (FIG. 3A) within the motor unit 104. Although it is shown that the cable 108 couples the drive unit 106 with the motor unit 104, other communication means are used, including but not limited to infra-red, radio frequency and optics. As will be described in detail below, in the alternative embodiment of the present invention, the drive unit 106 communicates with the motor unit 104 using radio frequency (RF) control. The cable 108 is secured to the pole 99 by a clip 130 (FIG. 1A). Since a sufficient amount of cable 108 is needed between the motor unit 104 and the drive unit 106 along the length of the pole 99, the number of clips 130 varies depending on the length of the wire 108 and the length of the pole 99. The clip 130 itself is a hook and loop clip or otherwise known as Velcro®, however any type of clip 130 is alternatively used.

Figure 16A:
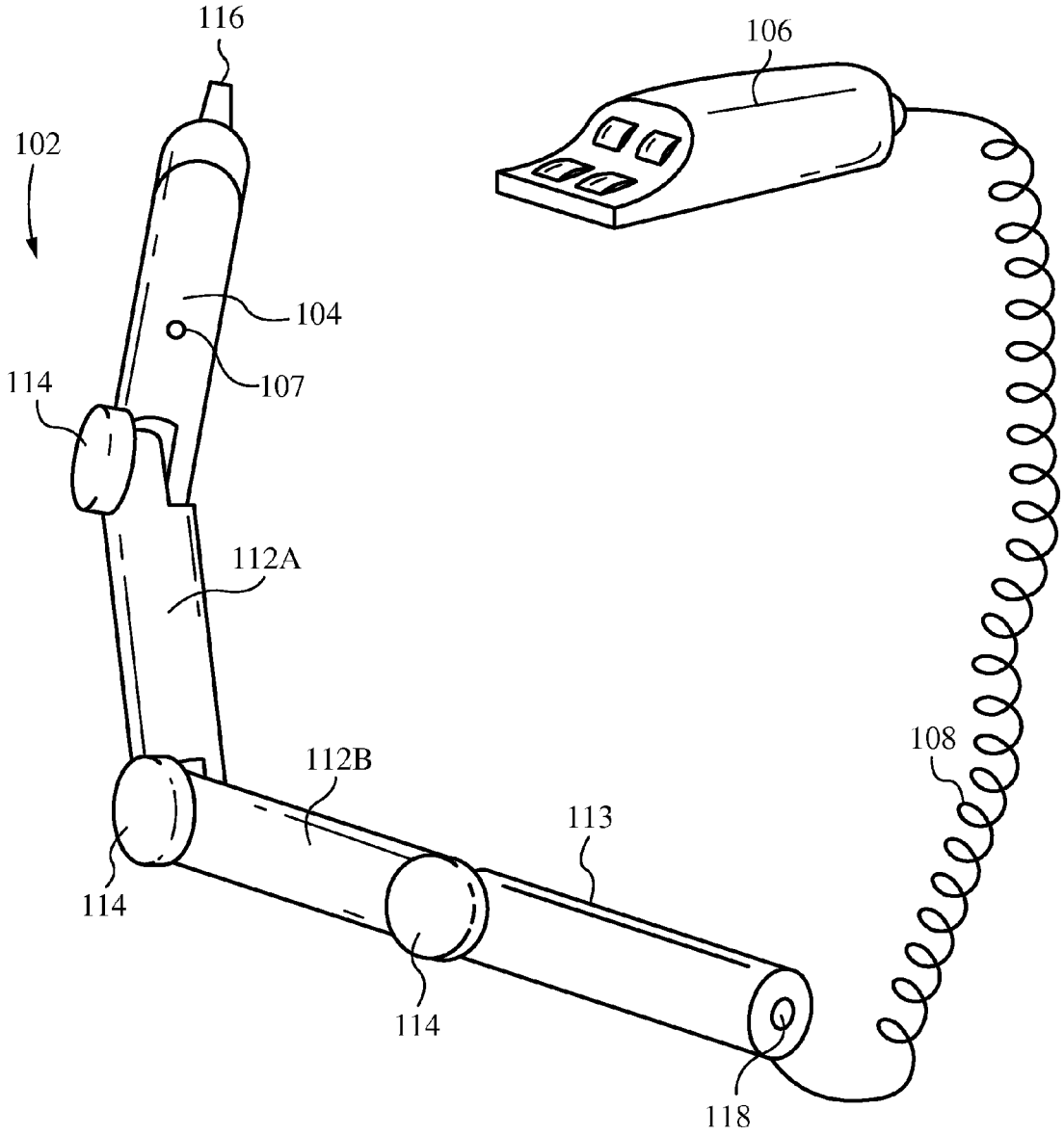
FIG. 16A illustrates a perspective view of an embodiment of the individual components of the motorized light bulb changer, in accordance with the present invention.
Figure 16B:
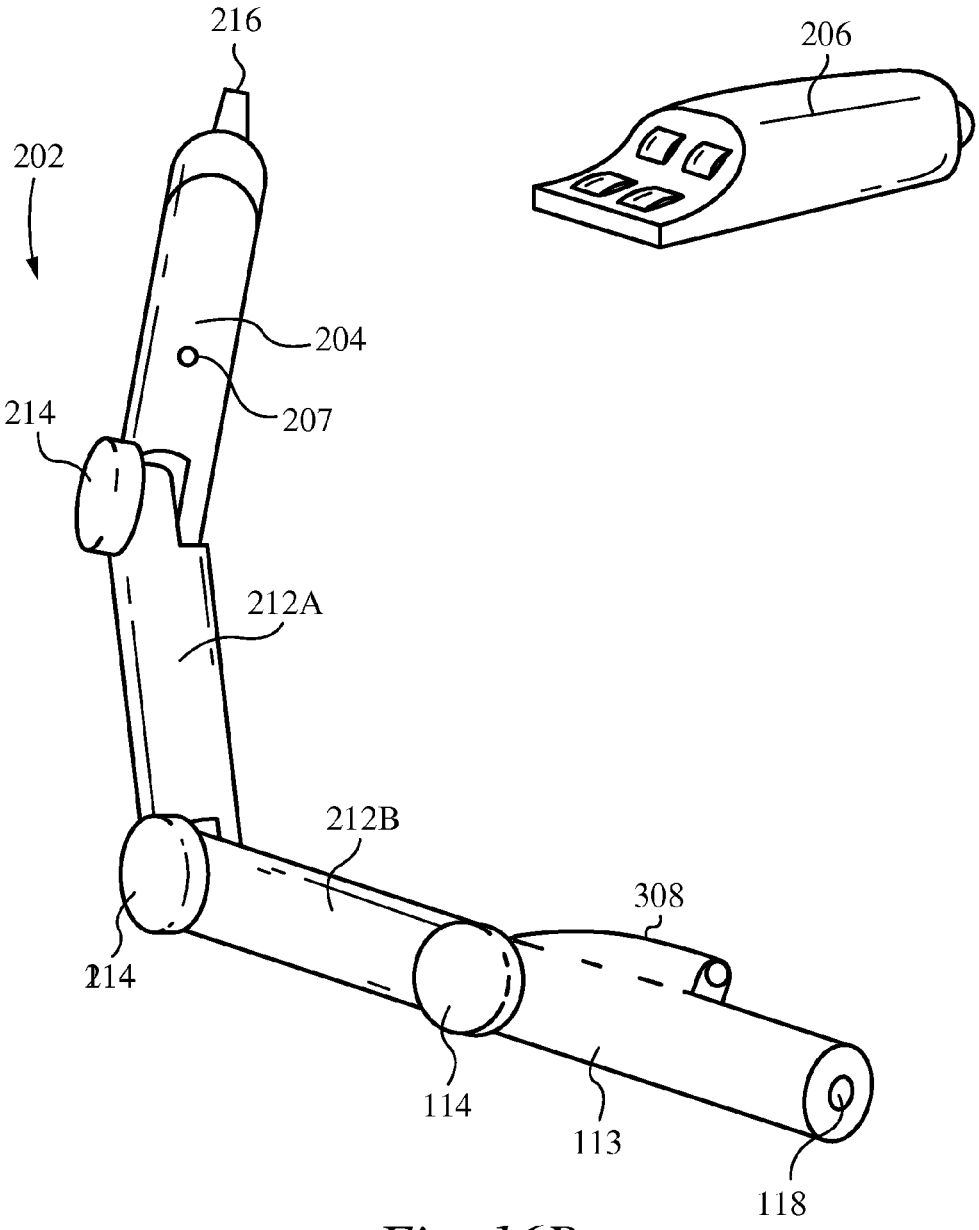
FIG. 16B illustrates a perspective view of an embodiment of the individual components of the motorized light bulb changer, in accordance with the present invention.

Further, in some embodiments, the control unit 106 is also configured to communicate with a force generator, e.g. 95 of FIG. 11, configured within a holding structure for attachment with the adapter 116, but alternatively configured within the motor unit 104. Further, as illustrated in FIGS. 16A and 16B, the auxiliary control switch 107 is also included on the motor unit 104. The force generator is activated or deactivated by either the control unit 106 or the auxiliary control switch 107 to selectively force a light bulb against the holding structure (not shown) or release a light bulb from the holding structure. The auxiliary control switch 107 facilitates use of the force generator system. Since an unscrewed lightbulb will remain forced against the holding structure until the force generator is deactivated, the user must deactivate the force generator to remove the light bulb easily. Since the control switch 107 is located within easy reach of the holding structure, the control switch 107 allows easy deactivation of the force generator while the user grasps a held light bulb. In some embodiments, the adapter 116 is configured to couple with a holding structure and includes an interface for communication with the force generator. Exemplary interfaces include electrical contacts, apertures, semi-permeable membranes, or porous structures.

Figure 3A:
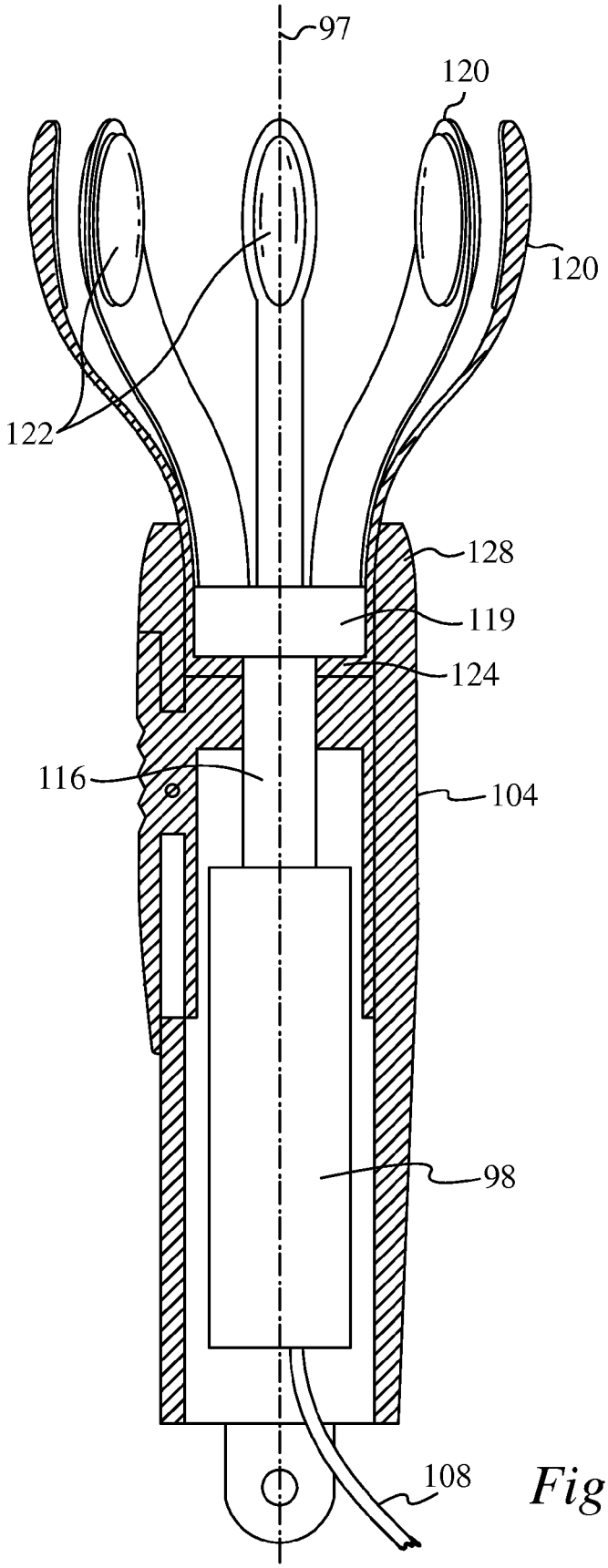
FIG. 3A illustrates a cross sectional view of an alternative embodiment of the clasping mechanism, in accordance with the present invention.

FIG. 3A illustrates a cross sectional view of the clasping mechanism 102 in accordance with an alternative embodiment of the present invention. The clasping mechanism 102 includes the motor unit 104 as well as an attachment 119 including a set of fingers 120 coupled to the motor unit 104. The motor unit 104 includes a step-motor 98 within its housing 128, wherein the motor 98 is coupled to the drive unit 106 by the cable 108. Alternatively, the motor 98 is any other appropriate type of motor known in the art, including but not limited to solenoid or direct voltage. The clasping mechanism 102 includes the adapter 116 which is configured to securely receive and hold the clasping attachment 119. Different sized attachments 119 are used to change different sizes of light bulbs.

In an alternative embodiment, the motor 98 controls the adapter 116 which extends out of the top of the motor 98 along the axis 97. In this alternative embodiment, the adapter 116 moves upward and downward as controlled by the motor unit 98 along the axis 97 depending on a predetermined voltage supplied to the motor 98, to either spread or tighten the fingers 120. In addition, the adapter 116 rotates in the clockwise and counterclockwise direction about the axis 97 depending on a predetermined voltage supplied to the motor 98. In addition, the clasping mechanism 102 of this alternative embodiment of the present invention can be used to grasp and manipulate objects other than light bulbs.

The wirelessly communicating drive unit 206 and motor unit 204 of the alternative embodiment are illustrated in FIG.

4. The drive unit 206 sends control signals to the infrared signal receiver 308 in the connecting arm 213 to control the operation of the motor unit 204. In some embodiments, the drive unit 206 is mounted to the bottom of the pole 99 and the motor unit 204 is mounted to the top of the pole 99. In some embodiments, the drive unit 206 is also self powered by batteries included within its casing.

Figure 4:
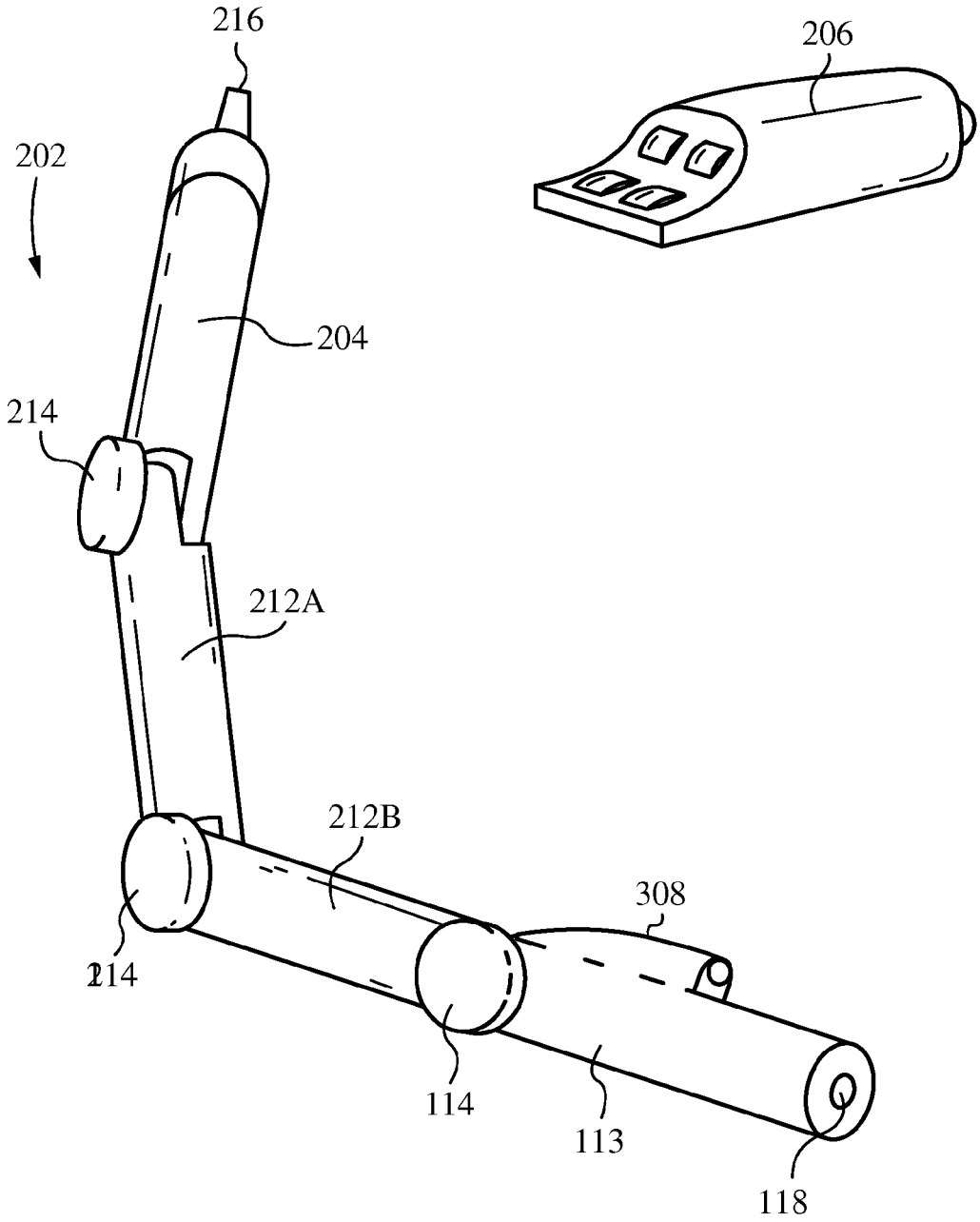
FIG. 4 illustrates a perspective view of an alternative embodiment of the individual components of the motorized light bulb changer, in accordance with the present invention.

Referring again to FIGS. 16A and 16B, as in the case of the drive unit of FIGS. 2 and 4 the control unit 206 is also configured to communicate with a force generator, e.g. 295 of FIG. 12, in some embodiments configured within a holding structure configured for attachment with the adapter 216, but alternatively configured within the motor unit 204, which will be discussed more fully below. Further, the auxiliary control switch 207 is also included on the motor unit 204. The force generator is activated or deactivated by either the control unit 206 or the auxiliary control switch 207 to selectively force a light bulb against the holding structure, e.g. 119 of FIG. 12, or release a light bulb from the holding structure. In some embodiments, the adapter 216 is configured to couple with a holding structure, and includes an interface for communication with the force generator. Exemplary interfaces include electrical contacts, apertures, semi-permeable membranes, or porous structures.

Referring again to FIG. 4, the clasping mechanism 202 of the alternative embodiment includes the wirelessly controlled motor unit 204, arm members 212A and 212B, connecting arm 213, knobs 214, adapter 205 and aperture 218. In some embodiments, the arm members 212A and 212B, the knobs 214, the adapter 215 and the aperture 218 all operate as described above in relation to FIG. 2.

Figure 5:
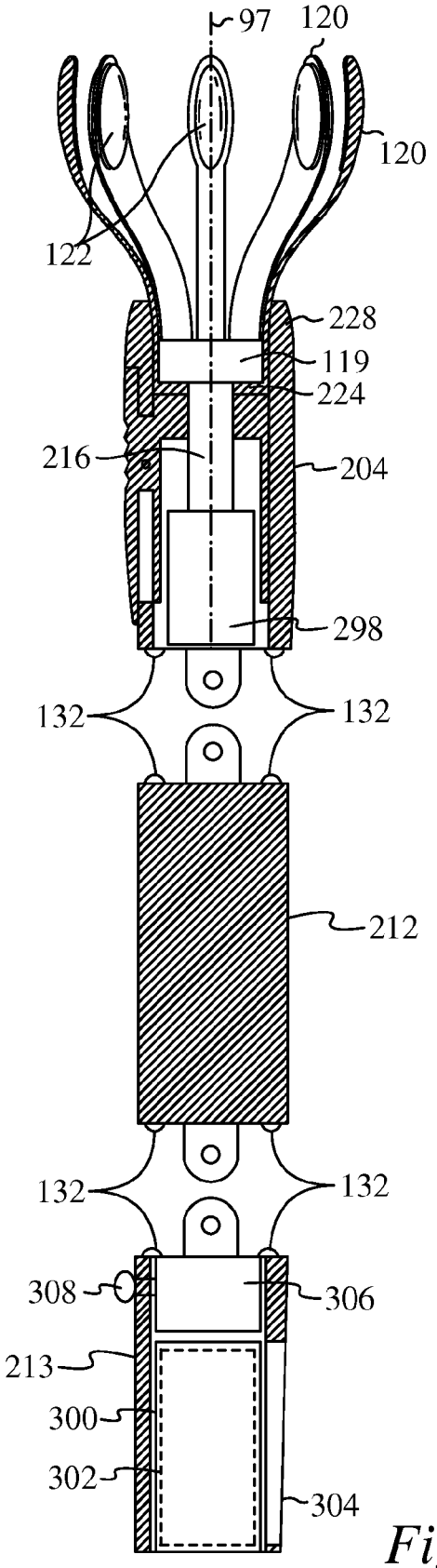
FIG. 5 illustrates a cross sectional view of an alternative embodiment of the clasping mechanism, in accordance with the present invention.

A cross sectional view of the alternative embodiment of the motor unit 204 is illustrated in FIG. 5. As shown in FIG. 5, the motor unit 204 is coupled to the arm member 212, whereby the arm member 212 is coupled to the connecting arm 213. In some embodiments, the motor unit 204 includes a DC linear rotational motor 298. Alternatively, the motor 298 is any other appropriate type of motor known in the art, such as a step motor. The controlling arm 213 includes a control unit 306 within its housing and a battery chamber 300 which is configured to hold one or more batteries 302 for powering the motor 298 and control unit 306. The batteries 302 are changed through a battery door 304. The clasping mechanism 202 includes the adapter 216 which is configured to securely receive and hold the clasping attachment 119. As described above, different sized attachments 119 are used to change different sizes of light bulbs.

The control unit 306 includes an infrared signal receiver 308 which receives control signals from the drive unit 206 for controlling the operation of the motor 298. Based on the control signals received from the drive unit 206, the control unit 306 then controls the operation of the motor 298 to turn in a clockwise or counter-clockwise direction. As shown in FIG. 5, in some embodiments, the motor unit 204, the arm member 212 and the controlling arm 213 each include a set of contact points 132 for supplying electrical current between the connecting arm 213 and the motor unit 204, to provide power and control signals to the motor 298. In some embodiments, any number of arm members 212 having contact points 132 are coupled together between the connecting arm 213 and the motor unit 204. Alternatively, the controlling arm 213 supplies electrical current to the motor unit 204 by a cable (not shown).

Figure 3B:
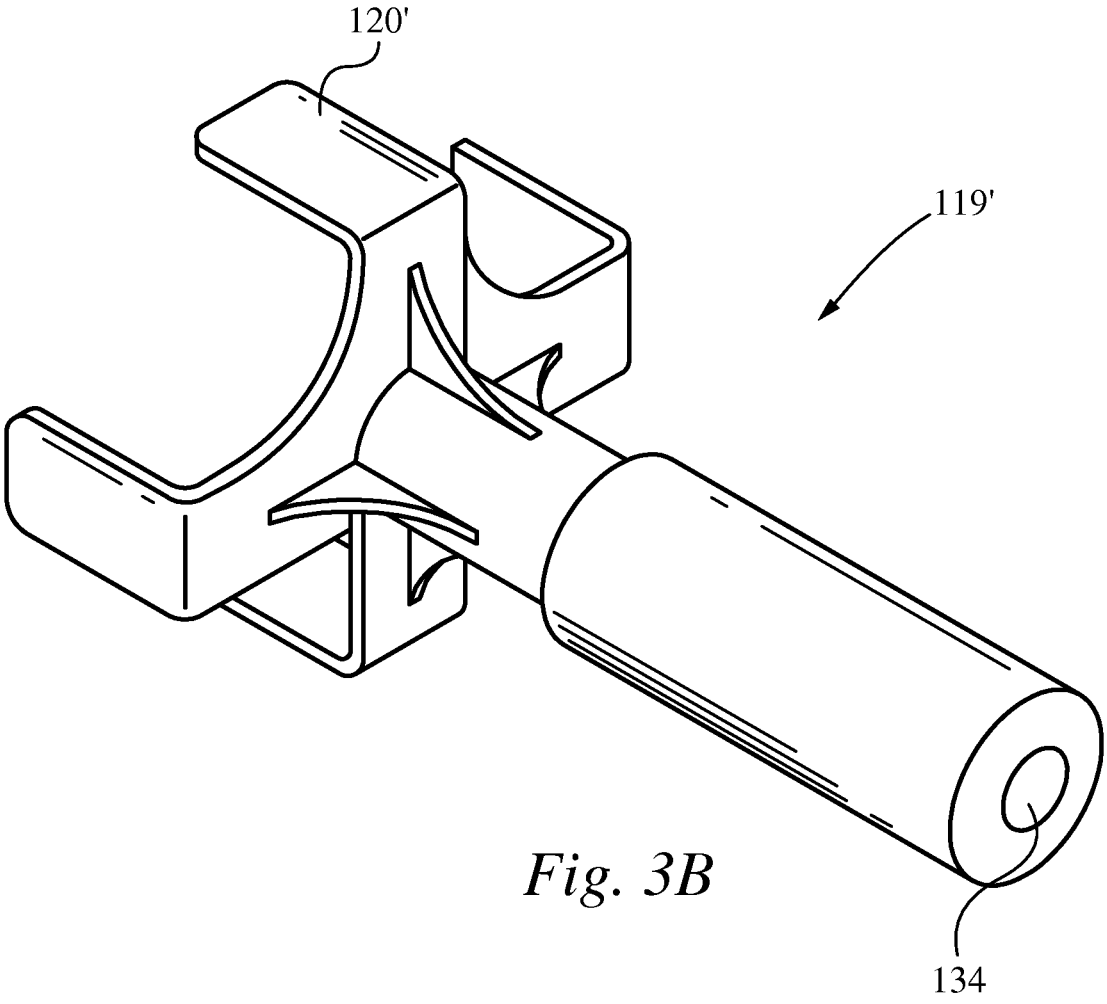
FIG. 3B illustrates a cross sectional view of an alternative embodiment of the fingers, in accordance with the present invention.

The clasping attachment, as shown in FIGS. 3A and 3B comprises a set of several fingers 120 for clasping the light bulb 96. In an embodiment, the clasping attachment 119' includes four fingers 120' which extend and are used in gripping the light bulb 96 as shown in FIG. 3B. In alternative embodiments, the clasping attachment 119' includes a clasping attachment aperture 134 for engaging the clasping attachment 119' to the adapter 116 (FIG. 3A). Alternatively, the fingers 120 extend in an octagonal pattern with pads 122 on the interior surface of each finger 120 which aid in gripping the light bulb 96, as shown in FIG. 3A. Alternatively, any other number of fingers 120 are used to grip the light bulb 96. Alternatively, each pad 122 is set and attached to the interior of each finger 120 by an adhesive, such as glue. Alternatively, any other appropriate means of attaching the pad 122 to the finger 120 is used. The fingers 120 are alternatively tensioned or spring urged to snugly fit over the light bulb 96 to screw or unscrew the light bulb 96 from its socket. Each finger 120, as shown in FIGS. 3A and 5, has a profile such that a portion of the finger 120 is parallel to the axis 97 near the adapter 116 and gradually extends in an outward direction away from the axis 97 to the area where the pad 122 is attached. Further, in some embodiments, each finger 120 is made of an elastic material to allow the fingers 120 to bend toward or away from each other, depending on the size of the light bulb 96.

In some embodiments, the clasping mechanism 202 is able to rotate about the axis 97, thereby causing the fingers 120 to rotate in communication with the adapter 216 that is driven by the motor 298. The clasping mechanism 202 is thus able to rotate in a clockwise position or a counter-clockwise position relative to the axis 97. In other words, in some embodiments, the clasping mechanism 202 rotates clockwise or counter-clockwise depending on the controls received by the control unit 306 from the drive unit 206. Thus, the motor 298, when activated by the control unit 306, causes the adapter 216 to rotate about the axis 97, thereby causing the fingers 120 to rotate along with the adapter 216. The rotation of the fingers 120 in the clockwise rotation allows the user to screw in the light bulb 96 (FIG. 1A). In contrast, the rotation of the fingers 120 in the counter-clockwise rotation allows the user to unscrew the light bulb 96 (FIG. 1A). It should be noted that the set of fingers 120 rotates clockwise or counter-clockwise independently of the configuration or position of the clasping mechanism 202 and the pole 99.

In the alternative embodiment, as shown in FIG. 3A, the clasping mechanism 102 is also able to move in another direction such that a distance or dimension between oppositely facing fingers 120 varies or adjusts to allow the clasping mechanism 102 to clasp or engage different sized light bulbs 96. As shown in FIG. 3A, each finger 120 in the clasping mechanism 102 has a protruding tab 124 which fits beneath the adapter 116. As stated above, the adapter 116 is positioned inside the motor unit 104 and moves upwards and downwards along the axis 97. In addition, in this embodiment the adapter 116 moves in various positions anywhere along the axis 97 depending on the amount of voltage supplied to the motor 98 by the drive unit 106. A predetermined voltage supplied by the drive unit 106 to the motor 98 will cause the adapter 116 to move upward along the axis 97. In contrast, a different predetermined voltage supplied by the drive unit 106 to the motor 98 will cause the adapter 116 to move downward along the axis 97.

As shown in FIG. 3A, the fingers 120 have an outward extending configuration and are located adjacent to the housing 128 of the motor unit 104. Since the fingers 120 are coupled to the adapter 116, movement of the adapter 116 in the downward direction along the axis 97 causes the outer surface profile of each finger 120 to move toward each other and toward the axis 97, itself. Thus, voltage supplied by the drive unit 106 which causes the adapter 116 to move downward causes the dimension between oppositely facing fingers 120 to decrease. In contrast, since the profile of each finger 116 gradually extends in an outward direction away from the axis 97, the oppositely facing fingers naturally move away from the axis 97 as the adapter moves upward along the axis 97. Thus, voltage supplied by the drive unit 106 which causes the adapter 116 to move upward causes the dimension between oppositely facing fingers 120 to increase. Therefore, the change in position of the adapter 116 within the housing 128 of the motor unit 104 adjusts the dimension or spacing between the fingers 120 to allow the clasping mechanism 102 to clasp different sized light bulbs 96 ranging from flood lights to Christmas bulbs.

The operation in screwing in a light bulb 96 will now be discussed. In operation, as shown in FIG. 1, the user couples the lower arm 112 having the aperture 118 to one end 99A of the pole 99 by a set of clips 130. The user then couples the drive unit 106 to the other end 99B of the pole 99. The user then secures the cable between the motor unit 104 and the drive unit 106 by using an appropriate number of clips, as mentioned above. It should be understood that the drive unit 206 and the motor unit 204 of the alternative embodiment, are coupled to the pole 99 in a similar manner, without the cable 108. Once the motorized light bulb changer 100 is coupled to the pole 99 and is sufficiently secure, the arm members 112 and connecting arm 113 are adjusted to the desired configuration by use of the knobs 114. Once the desired configuration is attained, the user adjusts the knobs 114 to allow the clasping mechanism 102 to reach the socket which receives the light bulb 96. The user then adjusts the length of the light bulb changer 100, if necessary. The user then positions the fingers 120 around the light bulb 96 and engages the light bulb 96. In some embodiments, this is done by coupling the appropriate sized clasping attachment 119' (FIG. 3B) to the adapter 116. Alternatively, this is done by pressing the corresponding button on the drive unit 106, whereby the drive unit 106 will supply an appropriate voltage to activate the adapter 116. Once the light bulb 96 is engaged within the clasping mechanism 102, the user places the light bulb in the corresponding socket (FIG. 1A) and presses the corresponding button on the drive unit 106 to activate the clasping mechanism 102. The voltage applied by the drive unit 106 causes the motor 98 and the adapter 116 to rotate clockwise. The motion of the adapter 116 causes the fingers 120 to rotate accordingly. Thus, a clockwise rotation of the motor 98 and adapter 116 causes the fingers 120 to rotate clockwise in any orientation of the arms 112. Unscrewing the light bulb 96 is done by the same method, except that the user presses the button on the drive unit 106 to turn the clasping mechanism 102 counterclockwise.

FIG. 11 illustrates a cross sectional view of an embodiment of a light bulb changer portion 102 in accordance with the present invention. The light bulb changer portion 102 includes the motor unit 104 as well as a holding structure 119 including the holding cup 121 coupled to the motor unit 104. The holding structure 119 further includes the force generator 95. The motor unit 104 includes a step-motor 98 within its housing 128, wherein the motor 98 is coupled to the control unit 106 by the cable 108. Alternatively, the motor 98 is any other appropriate type of motor known in the art, including but not limited to solenoid or direct voltage. The motor unit 104 includes the adapter 116 which is configured to securely receive and hold the holding structure 119. In addition, the adapter 116 includes an interface for communication with the force generator 95. In some embodiments, a single universal holding structure 119 is provided. Alternatively, different sized holding structures 119 are used to change different sizes of light bulbs.

In this aspect, in some embodiments, the holding cup 121 includes an interface 123 for communication with the force generator 95 and the light bulb. In one exemplary aspect, the force generator 95 forms negative pressure and the negative pressure is provided to the interface, forcing the light bulb against the holding cup 121. In this aspect, the interface comprises an aperture as illustrated; alternatively, the interface includes a semipermeable membrane or a porous structure.

In this embodiment, the holding structure 119 includes an interface for communication between the force generator 95 and the adapter 116. In some embodiments, signals from the cable 108 are passed through the interface to control the force generator 95. In addition, in this embodiment the force generator 95 activates or deactivates depending on the amount of voltage supplied through the cable 108 to the interface at the adapter 116. A predetermined voltage supplied through the cable 108 will cause the force generator 95 to activate and force a light bulb against the holding cup 121. In contrast, a different predetermined voltage supplied by the control unit 106 will cause the force generator 95 to deactivate and release the light bulb from the holding cup 121.

Figure 12:
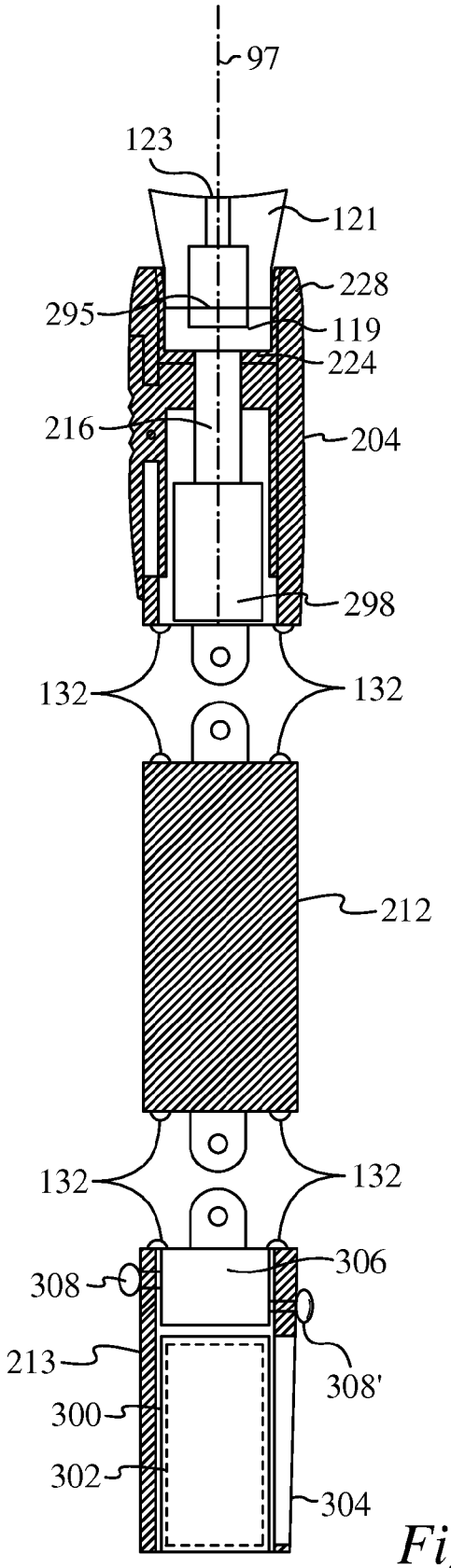
FIG. 12 illustrates a cross sectional view of an embodiment of the clasping mechanism, in accordance with the present invention.

FIG. 12 illustrates a cross sectional view of an embodiment of the motor unit 204. Though the some of the embodiments bear a resemblance to other embodiments such as the embodiment illustrated in FIG. 5, there are several key differences. Primarily, the holding structure 119 no longer includes the gripping means 120, but instead includes only the holding cup 121. Further, the holding structure 119 includes the force generator 295. The force generator 295 exerts force on a light bulb through the interface 123. In this embodiment, the force generator 295 is controlled by the controller 306, which also controls the motor 298.

Though many force generators are contemplated in the present invention, in the illustrated embodiment, the force generator 295 is a suction generating device, such as a vacuum pump, in some embodiments. In addition, in some embodiments, the force generator 295 can generate a positive pressure, e.g. through reversal of the vacuum system. Further, the interface 123 is in this case an aperture, but alternatively is a semipermeable membrane or porous structure.

In this embodiment, the controller 306 includes an infrared signal receiver 308 which receives control signals from the control unit 206 for controlling the operation of the force generator 295. Further, the auxiliary control switch 308' also controls the controller 306. Based on the control signals received from the control unit 206 (or the auxiliary control switch 308), the controller 306 then controls the operation of the force generator 295 to force the light bulb against the holding cup 121, or to release the light bulb from the holding cup 121. As shown in FIG. 5, in some embodiments, the motor unit 204, the arm member 212 and the controlling arm 213 each include a set of contact points 132 for supplying electrical current between the connecting arm 213 and the motor unit 204, to provide power and control signals to the force generator 295. In some embodiments, any number of arm members 212 having contact points 132 are coupled together between the connecting arm 213 and the motor unit 204. Alternatively, the controlling arm 213 supplies electrical current to the motor unit 204 by a cable.

As in the previously discussed embodiment, the holding structure 119 is selectively rotated. Thus, since the light bulb is selectively forced against the holding cup 121, the light bulb too is selectively rotated. Therefore, when a light bulb (96 of FIG. 1A) is held against the holding cup 121, clockwise rotation of the holding structure 119 allows the user to screw in the light bulb and counter-clockwise rotation of the of the holding structure 119 allows the user to unscrew the light bulb. It should be noted that the holding structure 119 rotates clockwise or counter-clockwise independently of the configuration or position of the arm member 202 and the pole 99.

Figure 6:
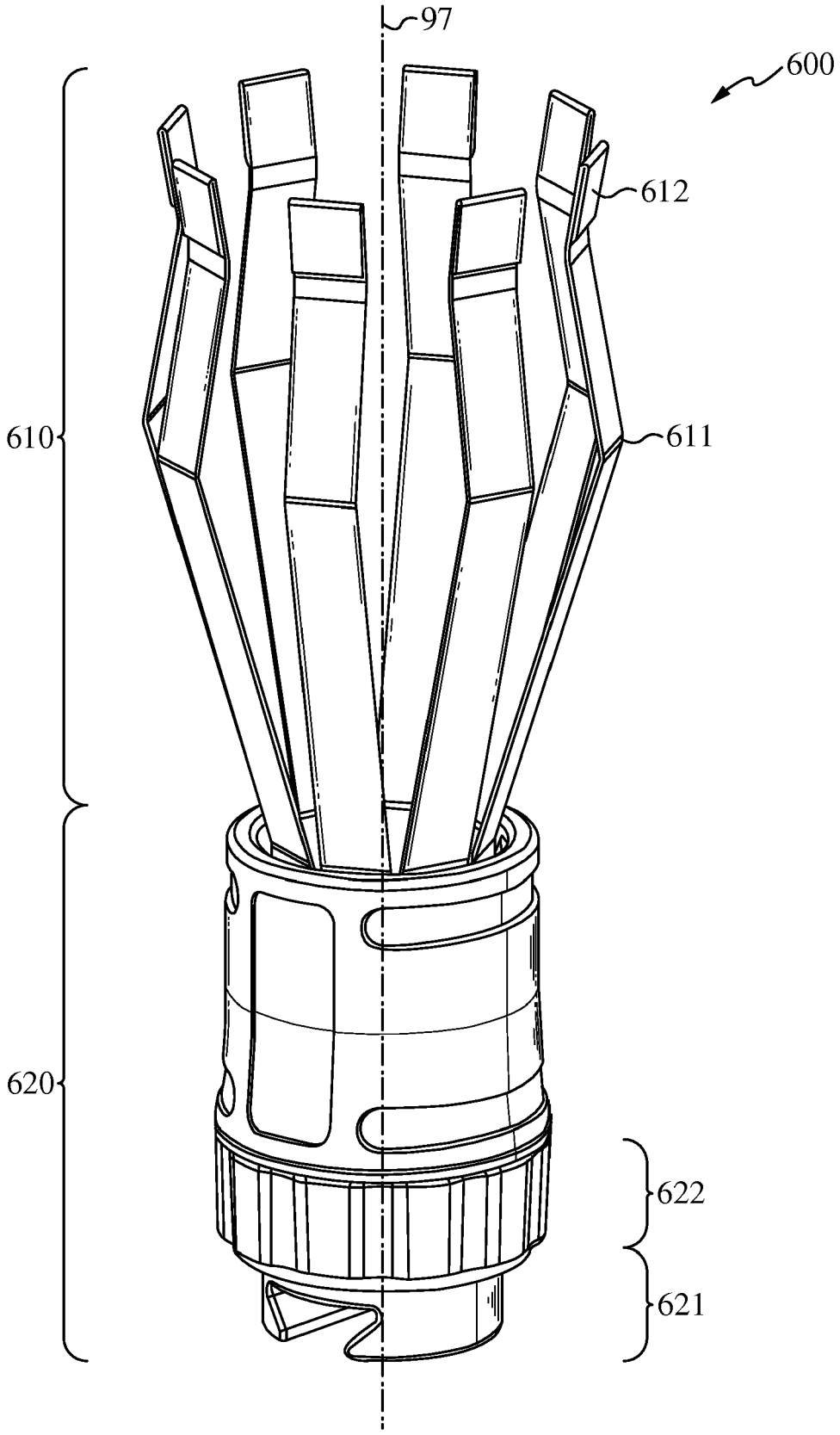
FIG. 6 illustrates a customizable light bulb changer, in accordance with the present invention.

A customizable light bulb changer 600 is illustrated in FIG. 6. The light bulb changer 600 comprises a plurality of articulated fingers 610. Each of the plurality of articulated fingers 610 comprises a plurality of hinges 611. The plurality of articulated fingers 610 are configured to engage a lightbulb (not shown). The light bulb changer 600 further comprises a telescoping collar 620 that is coupled to the plurality of articulated fingers 610 and a turn knob 722 that is moved to secure the telescoping collar 620 in position. The telescoping collar 620 is configured to adjust the size of the plurality of articulated fingers 610. Further, the telescoping collar 620 comprises an interconnect 621. In one embodiment, each of the plurality of articulated fingers 610 comprises a tip 612. In some embodiments, a support for the articulated fingers 610 includes markings corresponding to settings for specific lightbulb sizes such that by moving the telescoping collar 620 to the appropriate marking, the articulated fingers 610 are set for the corresponding sized light bulb. Further, once the telescoping collar 620 is set to the appropriate location, the turn knob 622 is then tightened to secure the telescoping collar 620 in that location. In other embodiments, the tip 612 comprises rubber. In one embodiment, the light bulb changer 620, the telescoping collar 620, and the plurality of articulated fingers 610 comprise a non-electrical conducting material. In one embodiment, the non-electrical conducting material comprises plastic. In another embodiment, the non-electrical conducting material comprises polymer. In yet another embodiment, the plurality of articulated fingers 610 comprise a metal. In some embodiments, the interconnect 621 is configured to detachably couple to an arm member 112 (not shown). The arm member 112 (not shown) is configured for positioning the customizable light bulb changer 600 in a desired configuration to engage the light bulb (not shown).

The light bulb is selected from the group comprising recessed type, flood light type, reflector type, regular household type, bent tip decorative type, torpedo shape type, beacon lamp type, track head type, candelabra type, globe type, or compact fixture type lightbulb. In another embodiment, the lightbulb comprises a bulbous portion and a narrow portion, wherein the narrow portion is narrower than the bulbous portion. It should be understood that this list only serves to provide examples, and does not serve to limit the type, size, or shape of the lightbulb to be engaged by the customizable light bulb changer 600.

Figure 7:
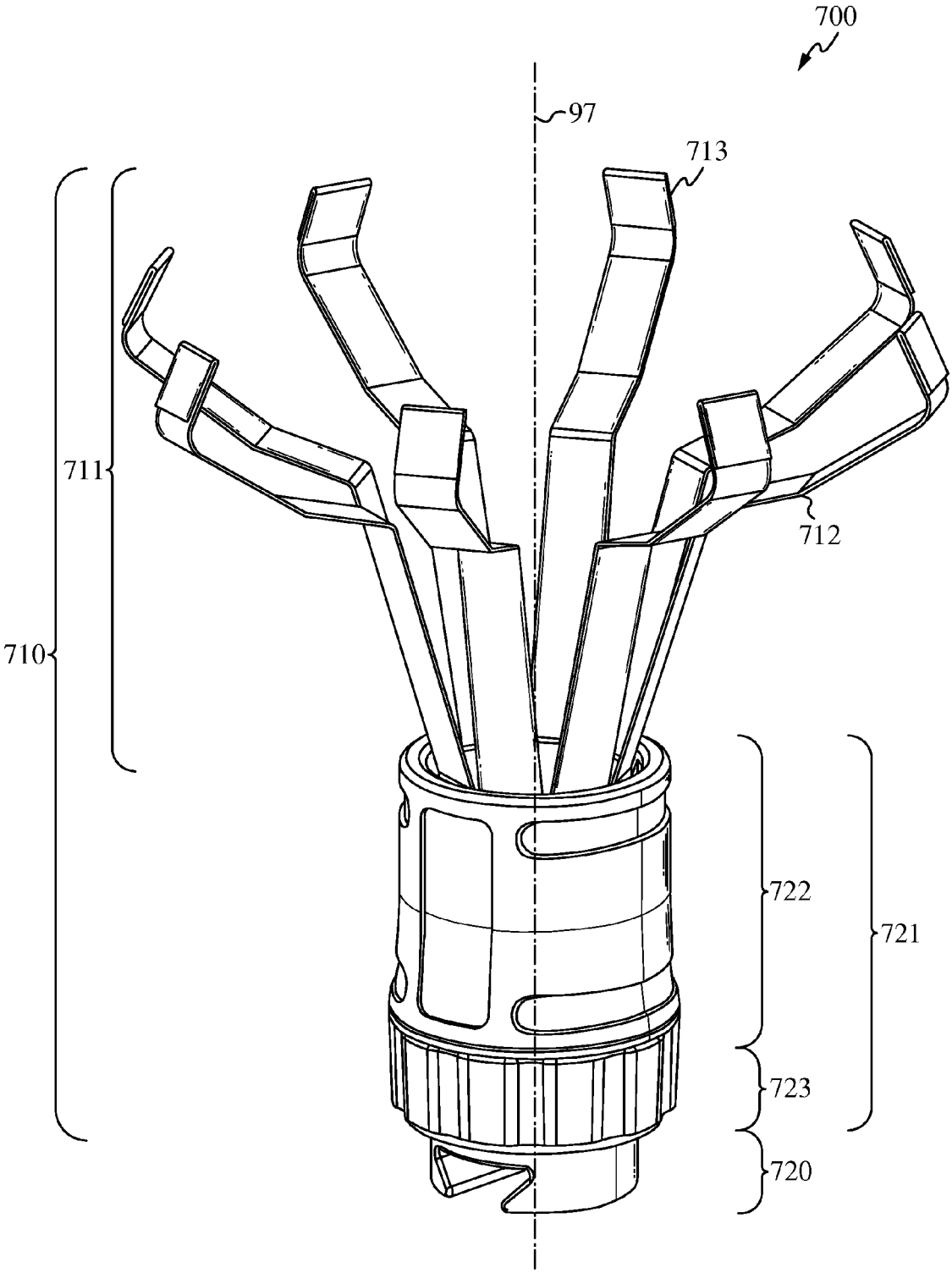
FIGS. 7 and 8 illustrate alternative embodiments of a customizable light bulb changing tool, in accordance with the present invention.
Figure 8:
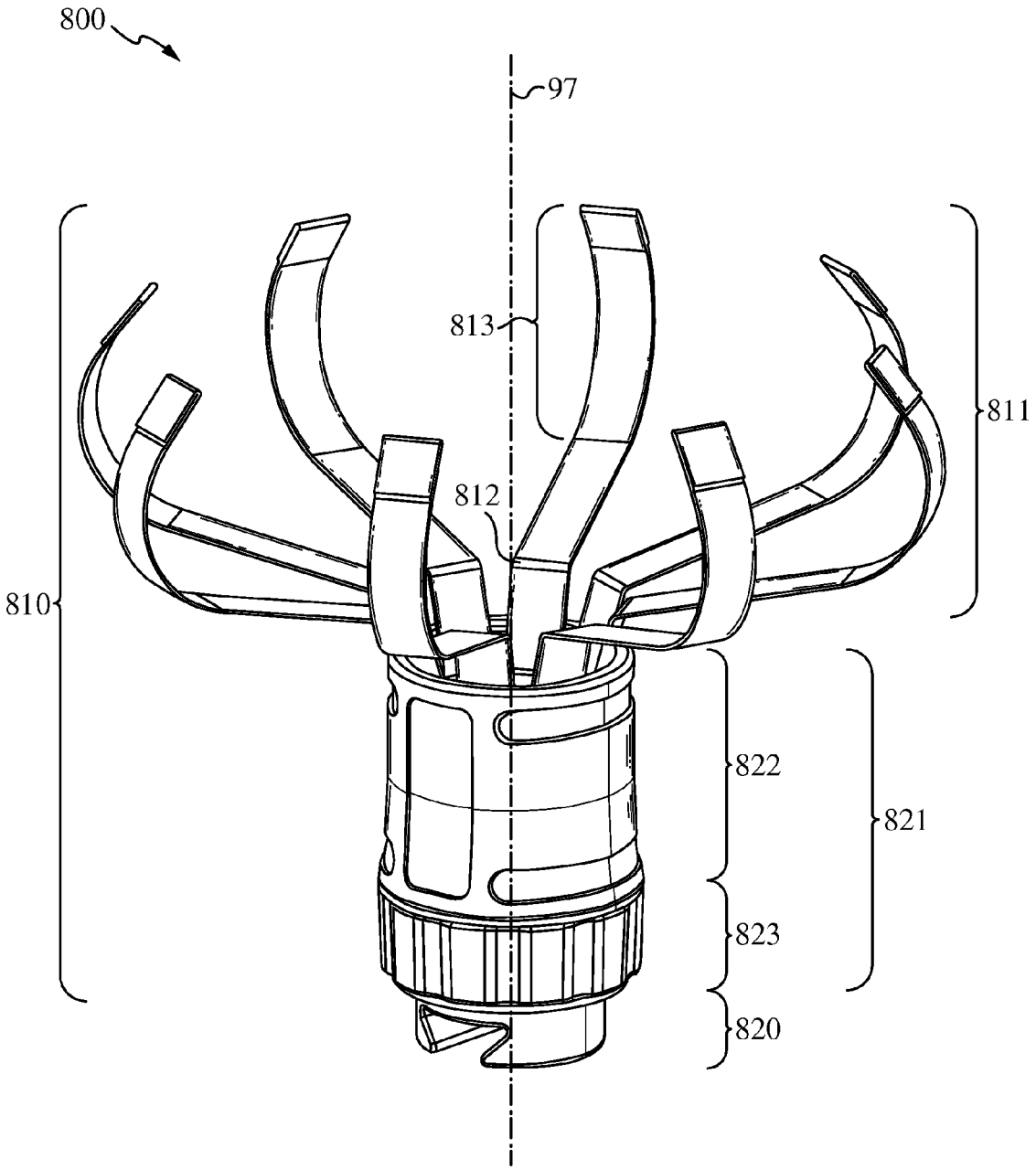

FIGS. 7 and 8 illustrate alternative embodiments of a customizable light bulb changing tool. For both FIGS. 7 and 8, the light bulb changing tools 700 and 800, respectively, are configured for selectively tightening and loosening a light bulb (not shown). The tool 700 and tool 800, respectively, comprise a means for clasping the light bulb 710 and 810, respectively, and an interconnect 720 and 820, respectively. In some embodiments, the interconnects 720 and 820, are configured to detachably couple to an arm member 112. The arm member 112 is configured for positioning the tool 700 or the tool 800 in a desired configuration to engage the light bulb, as discussed above.

In the embodiments illustrated in FIGS. 7 and 8, the clasping means 710 and 810, respectively, comprises a size adjusting means 721 and 821, respectively, and a plurality of articulated fingers 711 and 811, respectively. The size adjusting means 721 and 821, respectively, are configured to adjust the clasping means 710 and 810, respectively, to an adjustable dimension for clasping a correspondingly sized light bulb. Further, each of the plurality of articulated fingers 711 and 811, comprise a plurality of hinges 712 and 812, respectively, and a tip 713 and 813, respectively. FIG. 7 illustrates the customizable light bulb changer 700 comprising a tip 713 in a contoured configuration, and FIG. 8 illustrates the customizable light bulb changer 800 comprising a tip 813 in an arching configuration.

In one embodiment, the size adjusting means 721 and 821, respectively, comprise a telescoping collar 722 and 822, respectively. The size adjusting means 721 and 821, also comprises a turn knob 723 and 823, and a plurality of marks, as discussed above, corresponding to settings for specific lightbulb sizes, respectively. In some embodiments, the means for clasping 710 and 810, respectively, and the interconnect 720 and 820, respectively, comprise a non-electrical conducting material.

Figure 9:
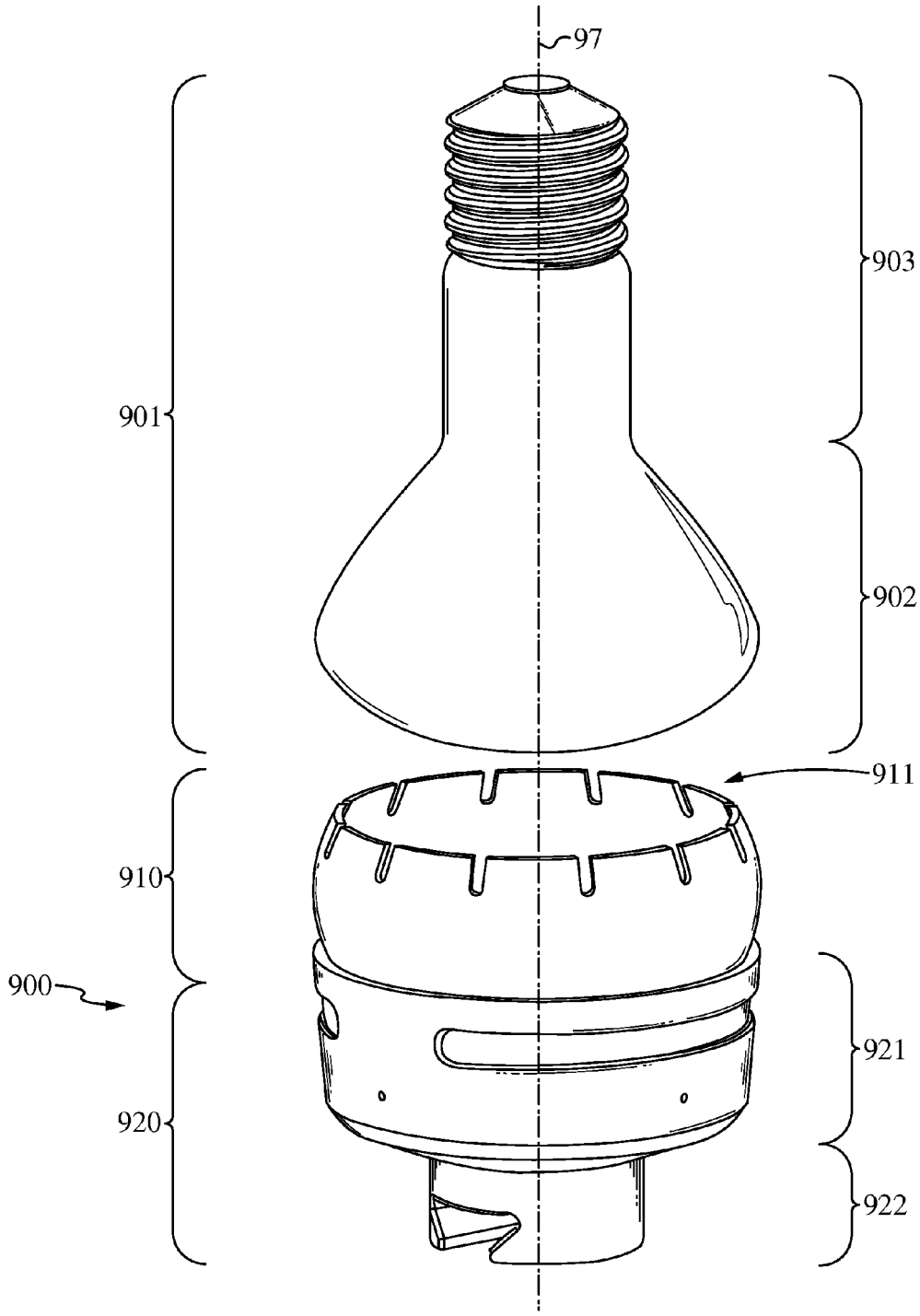
FIG. 9 illustrates an embodiment of a fitted cup light bulb changer, in accordance with the present invention.
Figure 10:
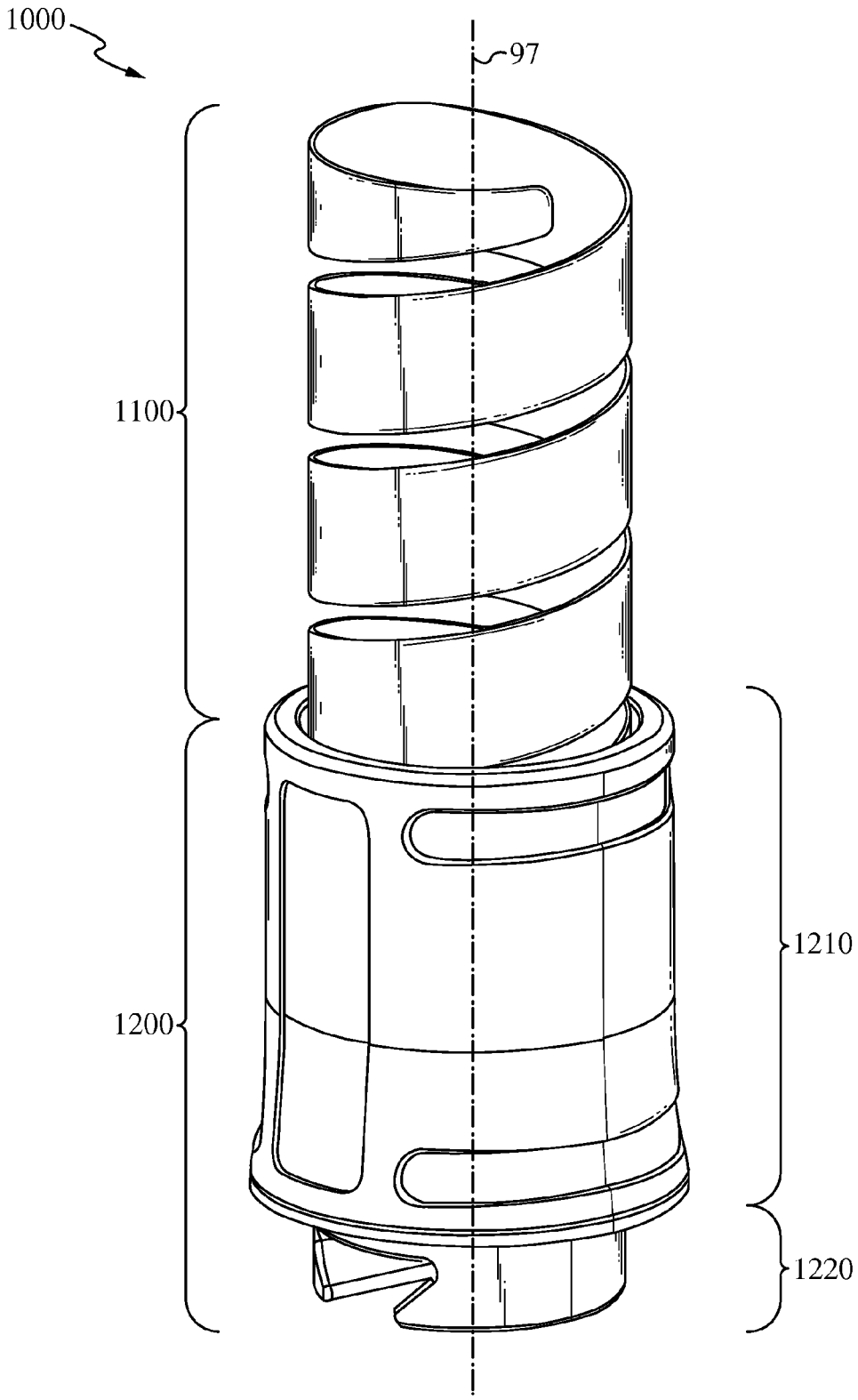
FIG. 10 illustrates an embodiment of a fitted helical structure light bulb changer, in accordance with the present invention.

FIGS. 9 and 10 illustrate embodiments of a fitted light bulb changer, in accordance with the present invention. In FIG. 9, the fitted cup light bulb changer 900 comprises a fitted cup gripping means 910 configured to engage and selectively tighten and loosen a light bulb 901 and an interconnect 922 coupled to the fitted cup gripping means 910. The fitted cup 910 comprises a fitted cup comprising a patterned lip 911. Further, in the fitted light bulb changer 900, the fitted cup 910 and the interconnect 922 are formed as a single-piece in an integral configuration. Regardless of the embodiment, the interconnect 920 is further configured to detachably couple to an arm member 112, as discussed above. The arm member 112 is configured for positioning the fitted cup light bulb changer 900 in a desired configuration to engage the light bulb 901. To engage the light bulb, the fitted cup 910 is slid over the bulbous portion 902 of the light bulb so that it is snugly engaged with the light bulb. The fitted cup light bulb changer 900 is then turned to either tighten or loosen the light bulb.

The light bulb is selected from the group comprising recessed type, flood light type, reflector type, regular household type, bent tip decorative type, torpedo shape type, beacon lamp type, track head type, candelabra type, globe type, or compact fixture type lightbulb. In another embodiment, the lightbulb 901, as illustrated comprises a bulbous portion 902 and a narrow portion 903, wherein the narrow portion 903 is narrower than the bulbous portion 902. It should be understood that this list only serves to provide examples, and does not serve to limit the type, size, or shape of the lightbulb to be engaged by the fitted light bulb changer 900.

The fitted cup 910 and the interconnect 922 of the fitted cup light bulb changer 900 comprise a non-electrical conducting material. In one embodiment, the non-electrical conducting material comprises plastic. In another embodiment, the non-electrical conducting material comprises polymer.

FIG. 10 illustrates an embodiment wherein the fitted gripping means of the fitted light bulb changer comprises a fitted helical structure. Specifically, the fitted helical structure light bulb changer 1000 illustrated in FIG. 10, comprises a fitted helical structure 1100 configured to engage and selectively tighten and loosen a light bulb and an interconnect 1200 coupled to the fitted helical structure gripping means 1100. In one embodiment of the fitted light bulb changer 1000, the fitted helical structure gripping means 1100 and the interconnect are formed as a single-piece in an integral configuration. Regardless of the embodiment, the interconnect 1200 is further configured to detachably couple to an arm member 112, as described above. The arm member 112 is configured for positioning the fitted light bulb changer 1000 in a desired configuration to engage the light bulb. The fitted helical structure 1100 engages the light bulb by rotating around the light bulb as the fitted helical structure 1100 is slid on to the light bulb. Once engaged with the light bulb, the fitted helical structure 1100 is then turned to either tighten or loosen the light bulb.

The light bulb is selected from the group comprising recessed type, flood light type, reflector type, regular household type, bent tip decorative type, torpedo shape type, beacon lamp type, track head type, candelabra type, globe type, or compact fixture type lightbulb. In another embodiment, the lightbulb comprises a bulbous portion and a narrow portion, wherein the narrow portion is narrower than the bulbous portion. It should be understood that this list only serves to provide examples, and does not serve to limit the type, size, or shape of the lightbulb to be engaged by the fitted light bulb changer 1000.

The fitted helical structure 1100 and the interconnect 1200 of the fitted helical structure light bulb changer 1000 comprise a non-electrical conducting material. In one embodiment, the non-electrical conducting material comprises plastic. In another embodiment, the non-electrical conducting material comprises polymer. In yet another embodiment, the fitted gripping means and the interconnect comprise a metal.

Figure 13:
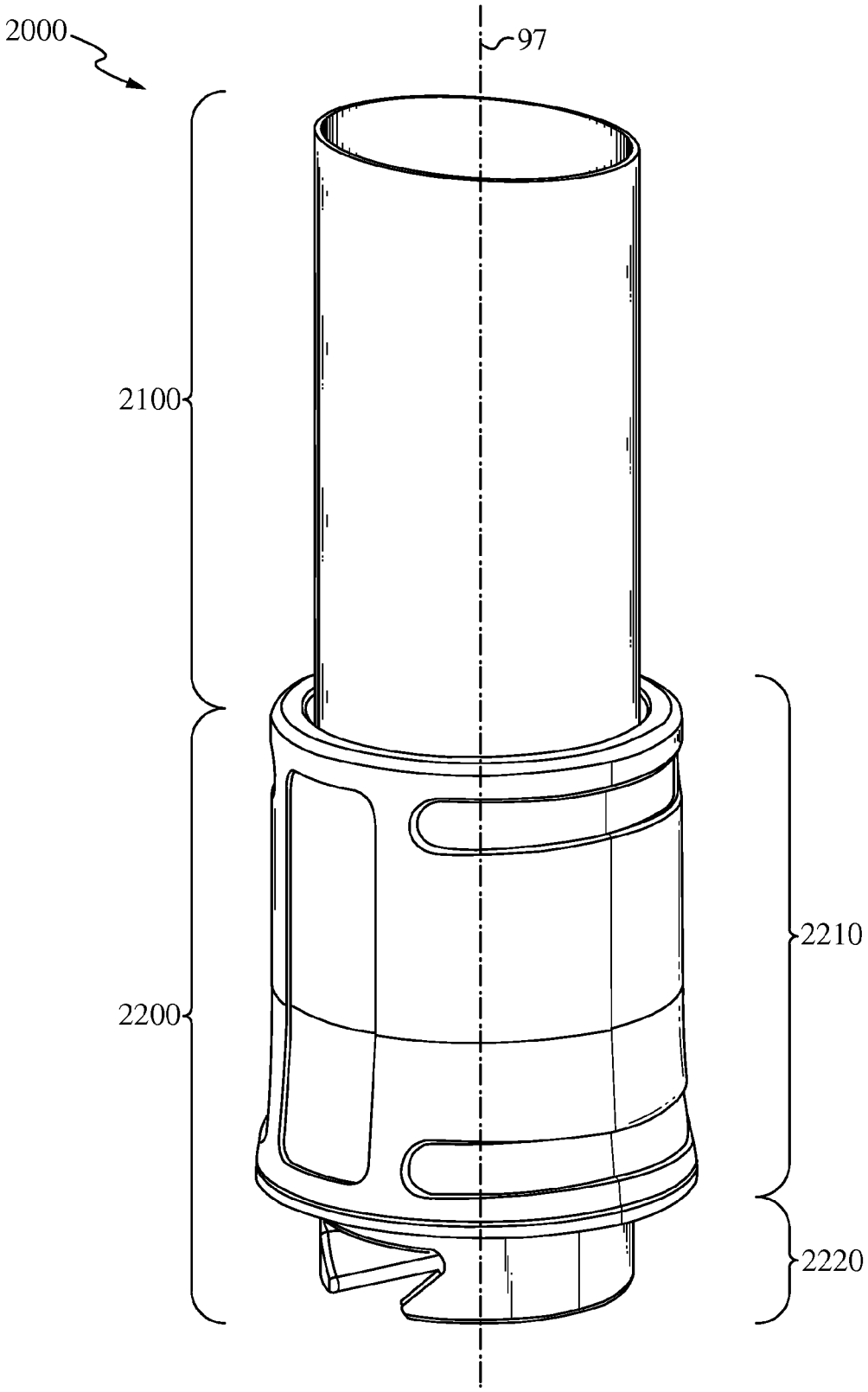
FIG. 13 illustrates an embodiment of a resilient tube structure light bulb changer, in accordance with the present invention.

FIG. 13 illustrates an embodiment wherein the holding means of the light bulb changer comprises a resilient tube structure 2100. Specifically, the resilient tube structure light bulb changer 2000 illustrated in FIG. 13, comprises a resilient tube structure 2100 configured to engage and selectively tighten and loosen a light bulb and an interconnect 2200 coupled to the resilient tube structure 2100. In one embodiment of the light bulb changer 2000, the resilient tube structure 2100 and the interconnect are formed as a single-piece in an integral configuration. Regardless of the embodiment, the interconnect 2200 is further configured to detachably couple to an arm member 112, as described above. The arm member 112 is configured for positioning the resilient tube light bulb changer 2000 in a desired configuration to engage the light bulb. In some embodiments, the resilient tube structure 2100 engages the light bulb by sliding on to the light bulb. Once engaged with the light bulb, the force generator (not shown) forces the light bulb against the resilient tube structure 2100, which is then turned to either tighten or loosen the light bulb.

In some embodiments, the force generator is a pressure generating device. The pressure generator is coupled to the resilient tube structure 2100 and configured to expand the resilient tube structure 2100, increasing its thickness in a direction perpendicular to the axis 97, and causing it to contact a light bulb therewithin and hold it. In alternative embodiments, the force generator is a suction generating device, configured to pull a light bulb into the resilient tube structure 2100 while deforming the tube structure against the light bulb, holding the light bulb.

The resilient tube structure 2100 and the interconnect 2200 of the resilient tube structure light bulb changer 2000 comprise a non-electrical conducting material. In one embodiment, the non-electrical conducting material comprises plastic. In another embodiment, the non-electrical conducting material comprises polymer. In yet another embodiment, the resilient tube structure and the interconnect comprise a metal.

Figure 14:
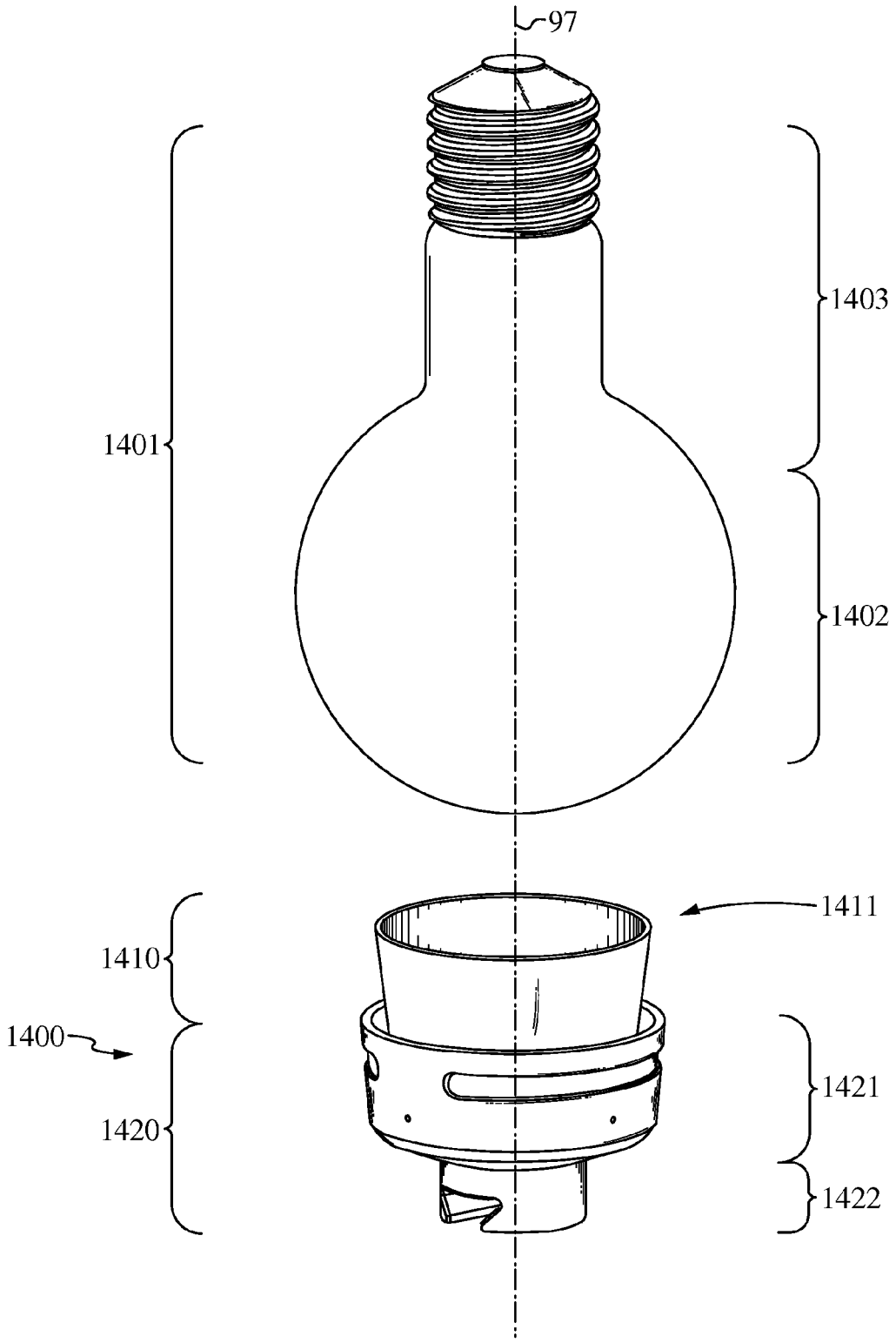
FIG. 14 illustrates an embodiment of a universal light bulb changer, in accordance with the present invention.

FIG. 14 illustrates an embodiment of a universal light bulb changer, in accordance with the present invention. In FIG. 14, the universal light bulb changer 1400 comprises a holding cup 1410 configured to engage and selectively tighten and loosen a light bulb 1401 and an interconnect 1422 coupled to the holding cup 1410. The holding cup 1410 comprises a holding cup comprising a sealing lip 1411. Further, in the universal light bulb changer 1400, the holding cup 1410 and the interconnect 1422 are formed as a single-piece in an integral configuration. Regardless of the embodiment, the interconnect 1420 is further configured to detachably couple to an arm member 112, as discussed above. The arm member 112 is configured for positioning the universal light bulb changer 1400 in a desired configuration to engage the light bulb 1401. To engage the light bulb, the holding cup 1410 is placed against the bulbous portion 1402 of the light bulb and the force generating means, e.g. 295 of FIG. 12, forces the light bulb against the holding cup 1410. The universal light bulb changer 1400 is then turned to either tighten or loosen the light bulb. Though the holding cup 1410 is shown to have an flared opening, other shapes are contemplated, including but not limited to cylindrical shapes, tapered shapes, and irregular shapes.

The holding cup 1410 and the interconnect 1422 of the universal light bulb changer 1400 comprise a non-electrical conducting material. In one embodiment, the non-electrical conducting material comprises plastic. In another embodiment, the non-electrical conducting material comprises polymer. In yet another embodiment, the non-electrical conducting material comprises rubber.

The light bulb is selected from the group comprising recessed type, flood light type, reflector type, regular household type, bent tip decorative type, torpedo shape type, beacon lamp type, track head type, candelabra type, globe type, or compact fixture type lightbulb. In another embodiment, the lightbulb 1401, as illustrated comprises a bulbous portion 1402 and a narrow portion 1403, wherein the narrow portion 1403 is narrower than the bulbous portion 1402. It should be understood that this list only serves to provide examples, and does not serve to limit the type, size, or shape of the light bulb to be engaged by the universal light bulb changer 1400 or the resilient tube structure light bulb changer 2000.

The holding cup 1410, and the resilient tube structure 2100 are each used to hold a light bulb 96 for tightening or loosening the light bulb. The resilient tube structure 2100 can be tensioned or spring urged, as described above, to snugly fit over the light bulb 96 to screw or unscrew the light bulb 96 from its socket. Further, the holding cup 1410 and the resilient tube structure 2100 both include interfaces for communication with a force generator configured to selectively force and release a light blue from against the holding cup 1410 and the resilient tube structure 2100 in some embodiments.

In some embodiments, the light bulb changing tool 1400 and the resilient tube structure light bulb changer 2000 (illustrated in FIG. 6) are able to rotate about the axis 97, thereby causing the respective the holding cup 1410, or the webbed helical structure 2100 to rotate in communication with the arm member 112 that is controlled by the motor 298, for example. The holding cup 1410, and the resilient tube structure 2100 are thus able to rotate in a clockwise position or a counter-clockwise position relative to the axis 97. In other words, the holding cup 1410, or the resilient tube structure 2100 rotate clockwise or counterclockwise depending on the controls received by the controller 306 from the control unit 206, in some embodiments. In an embodiment, the motor 298, when activated by the controller 306, causes the adapter 216 to rotate about the axis 97, thereby causing the holding cup 1410, or the resilient tube structure 2100 to rotate along with the adapter 216. When a light bulb is held against the holding cup 1410, or the resilient tube structure, clockwise rotation of the holding cup 1410, or the resilient tube structure 2100 allows the user to screw in the light bulb, while counter-clockwise rotation of the holding cup 1410, or the resilient tube structure 2100 in the counter-clockwise rotation allows the user to unscrew the light bulb 96. It should be noted that the holding cup 1410, or the resilient tube structure 2100 rotates clockwise or counter-clockwise independently of the configuration or position of the arm member 202 and the pole 99.

In some embodiments, the present invention is provided as an arm unit, e.g. 102 of FIG. 16A or 202 of FIG. 16B, and a plurality of attachments, e.g. 2000 of FIG. 13 and 1400 of FIG. 14. The force generator provided within the arm unit can provide positive or negative pressure. For certain embodiments of the attachments, e.g. 2000 of FIG. 13, positive pressure forces the lightbulb to be held by the attachment. For other attachments, e.g. 1400 of FIG. 14, negative pressure holds the lightbulb against the attachment. In some embodiments, a sensor within the coupling 116 of the arm unit detects the type of attachment provided and accordingly adjusts the signal sent from the control unit to the force generator to provide the correct type of pressure.

The plurality of articulated fingers 610, the plurality of articulated fingers 711, the plurality of articulated fingers 811, the fitted cup gripping means 910, and the fitted helical structure gripping means 1100 are each used to grip a light bulb 96 for tightening or loosening the light bulb. The plurality of articulated fingers 610, the plurality of articulated fingers 711, the plurality of articulated fingers 811, the fitted cup gripping means 910, or the fitted helical structure gripping means 1100 are tensioned or spring urged, as described above, to snugly fit over the light bulb 96 to screw or unscrew the light bulb 96 from its socket.

In some embodiments, the light bulb changer 600 (illustrated in FIG. 6), the light bulb changing tool 700 (illustrated in FIG. 7), the lightbulb changing tool 800 (illustrated in FIG. 8), the fitted cup light bulb changer 900, or the fitted helical structure light bulb changer 1000 (illustrated in FIG. 1000) are able to rotate about the axis 97, thereby causing the respective plurality of articulated fingers 610, the plurality of articulated fingers 711, the plurality of articulated fingers 811, the fitted cup gripping means 910, or the fitted helical structure gripping means 1100 to rotate in communication with the arm member 112 that is driven by the motor 298, for example. The plurality of articulated fingers 610, the plurality of articulated fingers 711, the plurality of articulated fingers 811, the fitted cup gripping means 910, or the fitted helical structure gripping means 1100 are thus able to rotate in a clockwise position or a counter-clockwise position relative to the axis 97. In other words, the plurality of articulated fingers 610, the plurality of articulated fingers 711, the plurality of articulated fingers 811, the fitted cup gripping means 910, or the fitted helical structure gripping means 1100 rotate clockwise or counterclockwise depending on the controls received by the control unit 306 from the drive unit 206, in some embodiments. In an embodiment, the motor 298, when activated by the control unit 306, causes the adapter 216 to rotate about the axis 97, thereby causing the plurality of articulated fingers 610, the plurality of articulated fingers 711, the plurality of articulated fingers 811, the fitted cup gripping means 910, or the fitted helical structure gripping means 1100 to rotate along with the adapter 216. The rotation of the plurality of articulated fingers 610, the plurality of articulated fingers 711, the plurality of articulated fingers 811, the fitted cup gripping means 910, or the fitted helical structure gripping means 1100 in the clockwise rotation allows the user to screw in the light bulb 96. In contrast, the rotation of the plurality of articulated fingers 610, the plurality of articulated fingers 711, the plurality of articulated fingers 811, the fitted cup gripping means 910, or the fitted helical structure gripping means 1100 in the counter-clockwise rotation allows the user to unscrew the light bulb 96. It should be noted that the plurality of articulated fingers 610, the plurality of articulated fingers 711, the plurality of articulated fingers 811, the fitted cup gripping means 910, or the fitted helical structure gripping means 1100 rotates clockwise or counter-clockwise independently of the configuration or position of the clasping mechanism 202 and the pole 99.

The operation in screwing in a light bulb 96 will now be discussed. In operation, as shown in FIG. 1, the user couples the lower arm 112 having the aperture 118 to one end 99A of the pole 99 by a set of clips 130. The user then couples the drive unit 106 to the other end 99B of the pole 99. The user then secures the cable between the motor unit 104 and the drive unit 106 by using an appropriate number of clips, as mentioned above. It should be understood that the drive unit 206 and the motor unit 204 of the alternative embodiment, are coupled to the pole 99 in a similar manner, without the cable 108. Once the motorized light bulb changer 100 is coupled to the pole 99 and is sufficiently secure, the arm members 112 and connecting arm 113 are adjusted to the desired configuration by use of the knobs 114.

In one aspect, once the desired configuration is attained, the user adjusts the knobs 114 to allow the light bulb changer 600 (illustrated in FIG. 6), the light bulb changing tool 700 (illustrated in FIG. 7), the lightbulb changing tool 800 (illustrated in FIG. 8), the fitted cup light bulb changer 900, or the fitted helical structure light bulb changer 1000 (illustrated in FIG. 1000) to reach the socket which receives the light bulb 96. The user then adjusts the length of the light bulb changer 100, if necessary. The user then positions the plurality of articulated fingers 610, the plurality of articulated fingers 711, the plurality of articulated fingers 811, the fitted cup gripping means 910, or the fitted helical structure gripping means 1100, as appropriate around the light bulb 96 and engages the light bulb 96. In some embodiments, this is done by coupling the appropriate sized one of the plurality of articulated fingers 610, the plurality of articulated fingers 711, the plurality of articulated fingers 811, the fitted cup gripping means 910, or the fitted helical structure gripping means 1100 to the arm member 112 using the interconnect. Alternatively, this is done by pressing the corresponding button on the drive unit 106, whereby the drive unit 106 will supply an appropriate voltage to activate the adapter 116. Once the light bulb 96 is engaged within the light bulb changer 600 (illustrated in FIG. 6), the light bulb changing tool 700 (illustrated in FIG. 7), the lightbulb changing tool 800 (illustrated in FIG. 8), the fitted cup light bulb changer 900 (illustrated in FIG. 9), or the fitted helical structure light bulb changer 1000 (illustrated in FIG. 10), the user places the light bulb in the corresponding socket (FIG. 1A) and presses the corresponding button on the drive unit 106 to activate the light bulb changer 600 (illustrated in FIG. 6), the light bulb changing tool 700 (illustrated in FIG. 7), the lightbulb changing tool 800 (illustrated in FIG. 8), the fitted cup light bulb changer 900 (illustrated in FIG. 9), or the fitted helical structure light bulb changer 1000 (illustrated in FIG. 10). The voltage applied by the drive unit 106 causes the motor 98 and the adapter 116 to rotate clockwise. The motion of the adapter 116 causes the plurality of articulated fingers 610, the plurality of articulated fingers 711, the plurality of articulated fingers 811, the fitted cup gripping means 910, or the fitted helical structure gripping means 1100 to rotate accordingly. Thus, a clockwise rotation of the motor 98 and adapter 116 causes the plurality of articulated fingers 610, the plurality of articulated fingers 711, the plurality of articulated fingers 811, the fitted cup gripping means 910, or the fitted helical structure gripping means 1100 to rotate clockwise in any orientation of the arms 112. Unscrewing the light bulb 96 is done by the same method, except that the user presses the button on the drive unit 106 to turn the light bulb changer 600 (illustrated in FIG. 6), the light bulb changing tool 700 (illustrated in FIG. 7), the lightbulb changing tool 800 (illustrated in FIG. 8), the fitted cup light bulb changer 900 (illustrated in FIG. 9), or the fitted helical structure light bulb changer 1000 (illustrated in FIG. 10) counterclockwise.

In some embodiments, once the desired configuration is attained, the user adjusts the knobs 114 to allow the universal light bulb changer 1400, or the resilient tube structure light bulb changer 2000 (illustrated in FIG. 6) to reach the region of the socket which receives the light bulb 96. The user then adjusts the length of the light bulb changer 100, if necessary. The user then positions the holding cup 1410, or the resilient tube structure 2100, as appropriate around or against the light bulb 96 and engages the light bulb 96. In some embodiments, this is done by pressing the corresponding button on the control unit 106, or the auxiliary control switch 107, which causes an appropriate voltage to activate the force generator and force the light bulb against the holding cup 1410, or the resilient tube structure 2100. Once the light bulb 96 is engaged within the holding cup 1410, or the resilient tube structure light bulb changer 2000, the user places the light bulb in the corresponding socket (FIG. 1A) and presses the corresponding button on the control unit 106 to apply a voltage to the motor (98 of FIG. 4) which causes the motor 98 and the adapter 116 to rotate clockwise. The motion of the adapter 116 causes the holding cup 1410, or the resilient tube structure 2100 to rotate accordingly. Thus, a clockwise rotation of the motor 98 and adapter 116 causes the holding cup 1410, or the resilient tube structure 2100 to rotate clockwise in any orientation of the arms 112. Unscrewing the light bulb 96 is done by the same method, except that the user presses the button on the control unit 106 to turn the holding cup 1410, or the resilient tube structure 2100, counterclockwise. To disengage the light bulb 96 from the holding cup 1410, or the resilient tube structure 2100, the user presses a corresponding button on the control unit 106, or the auxiliary control switch 107, which causes an appropriate voltage to deactivate the force generator and release the light bulb from the holding cup 1410, or the resilient tube structure 2100, in some embodiments. The user then removes the light bulb 96 from the holding cup 1410 or the resilient tube structure 2100.

Figure 17:
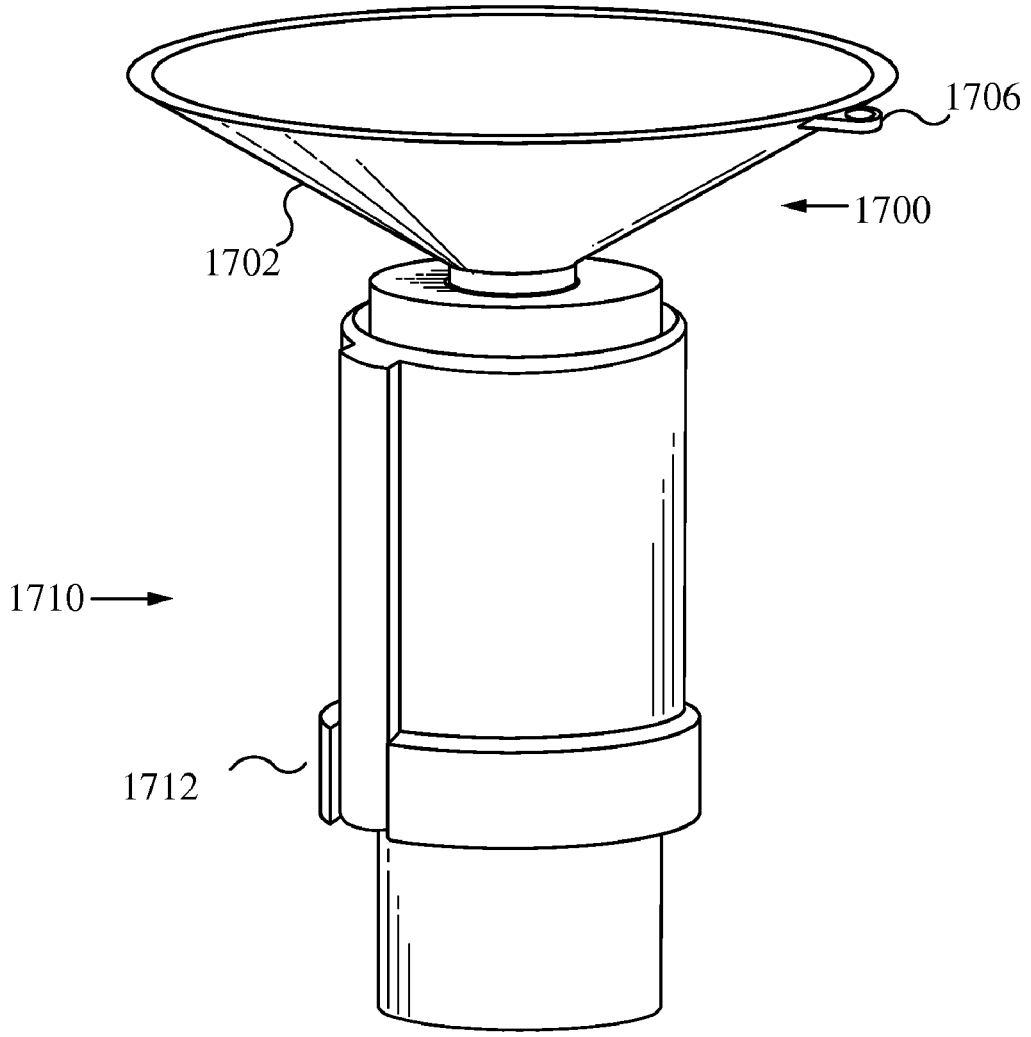
FIG. 17 illustrates an embodiment of a light bulb changer including a securing member, in accordance with the present invention.
Figure 18:
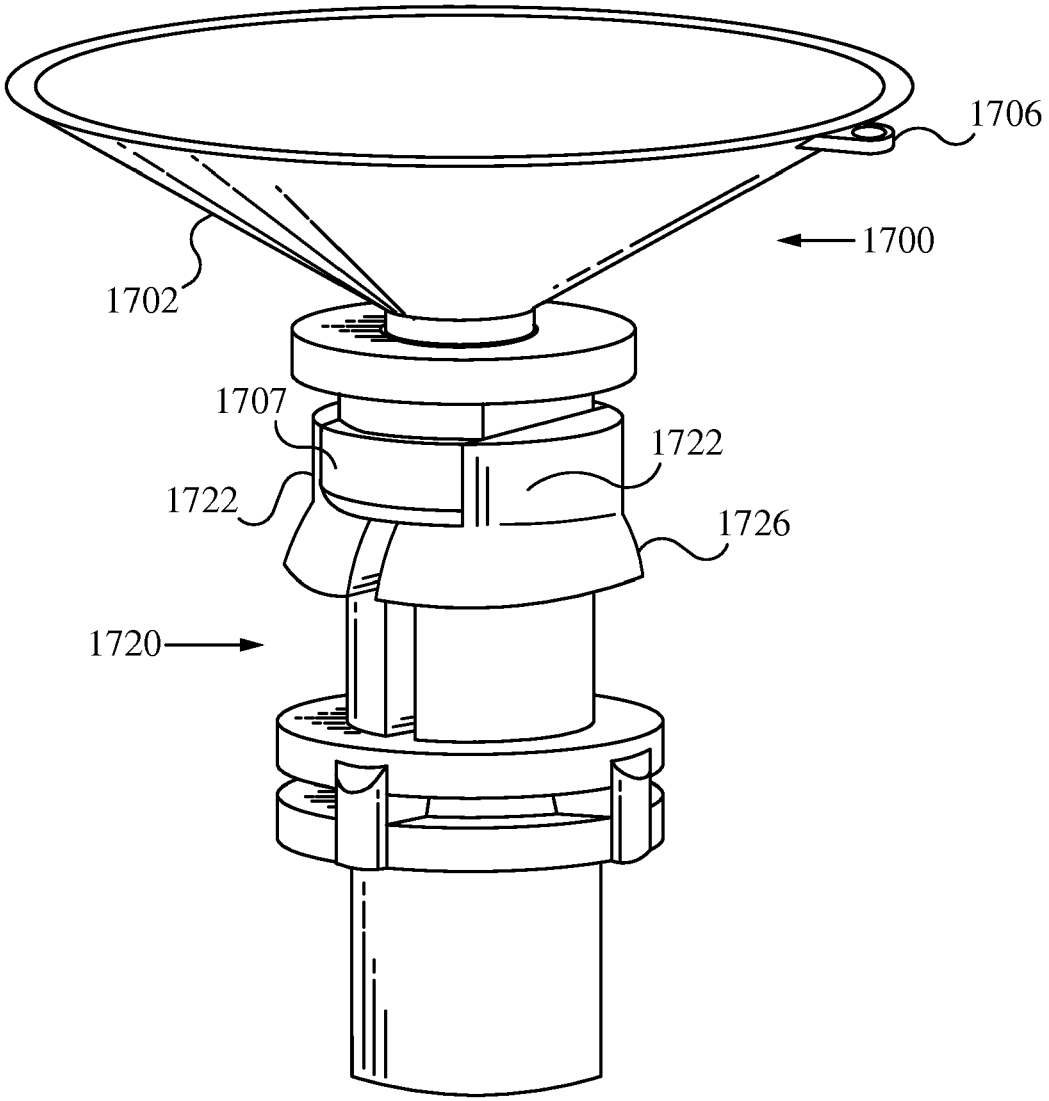
FIG. 18 illustrates an embodiment of a light bulb changer, in accordance with the present invention.

FIG. 17 illustrates an embodiment with a suction cup and with an interconnect including a securing member. Specifically, a suction cup light bulb changer 1700 illustrated in FIG. 17 comprises a holding cup 1702 configured to engage and selectively tighten and loosen a light bulb and a protruding member 1704 (FIG. 19) coupled to the holding cup 1702. In some embodiments of the suction cup light bulb changer 1700, the holding cup 1702 and the protruding member 1704 (FIG. 19) are formed as a single-piece in an integral configuration. In some embodiments, the holding cup 1702 and the protruding member 1704 (FIG. 19) are separate components. Regardless of the embodiment, the protruding member 1704 (FIG. 19) is further configured to detachably couple to a receiving member 1720 (FIG. 18) of an interconnect 1710. The protruding member 1704 (FIG. 19) is secured within the interconnect 1710 by a securing member 1712. In some embodiments, to install the holding cup 1702 within an interconnect 1710 coupled to an arm member 112 (FIG. 1) for use, the protruding member 1704 (FIG. 19) is positioned through an aperture 1714 (FIG. 19) within the securing member 1712 and is positioned within the receiving member 1720 (FIG. 18). Then, the securing member 1712 is positioned to prevent the protruding member 1704 (FIG. 19) from disengaging the receiving member 1720 (FIG. 18). In some embodiments, to remove the holding cup 1702 from the interconnect 1710, the securing member 1712 is positioned to enable the protruding member 1704 (FIG. 19) to disengage from the receiving member 1720 (FIG. 18). Then, the protruding member 1704 (FIG. 19) is pulled away from the receiving member 1720 (FIG. 18) and through the aperture 1714 (FIG. 19) of the securing member 1712. Positioning, as referred to above, includes rotating, sliding or any other means of movement into a desired position.

The interconnect 1710 couples to the arm member 112 (FIG. 1). In some embodiments, the interconnect 1710 detachably couples to the arm member 112 (FIG. 1). The arm member 112 (FIG. 1) is configured for positioning the suction cup light bulb changer 1700 in a desired configuration to engage the light bulb. The holding cup 1702 engages the light bulb by being pushed against the light bulb, similar to the use of a suction cup. Once engaged with the light bulb, the holding cup 1702 is then turned to either tighten or loosen the light bulb The holding cup 1702 includes a protrusion 1706 for assisting in alleviating the suction of the suction cup by enabling an edge to be lifted from the light bulb.

The light bulb is selected from the group comprising recessed type, flood light type, reflector type, regular household type, bent tip decorative type, torpedo shape type, beacon lamp type, track head type, candelabra type, globe type, or compact fixture type lightbulb. In another embodiment, the lightbulb comprises a bulbous portion and a narrow portion, wherein the narrow portion is narrower than the bulbous portion. It should be understood that this list only serves to provide examples, and does not serve to limit the type, size, or shape of the lightbulb to be engaged by the suction cup light bulb changer 1700.

Figure 19:
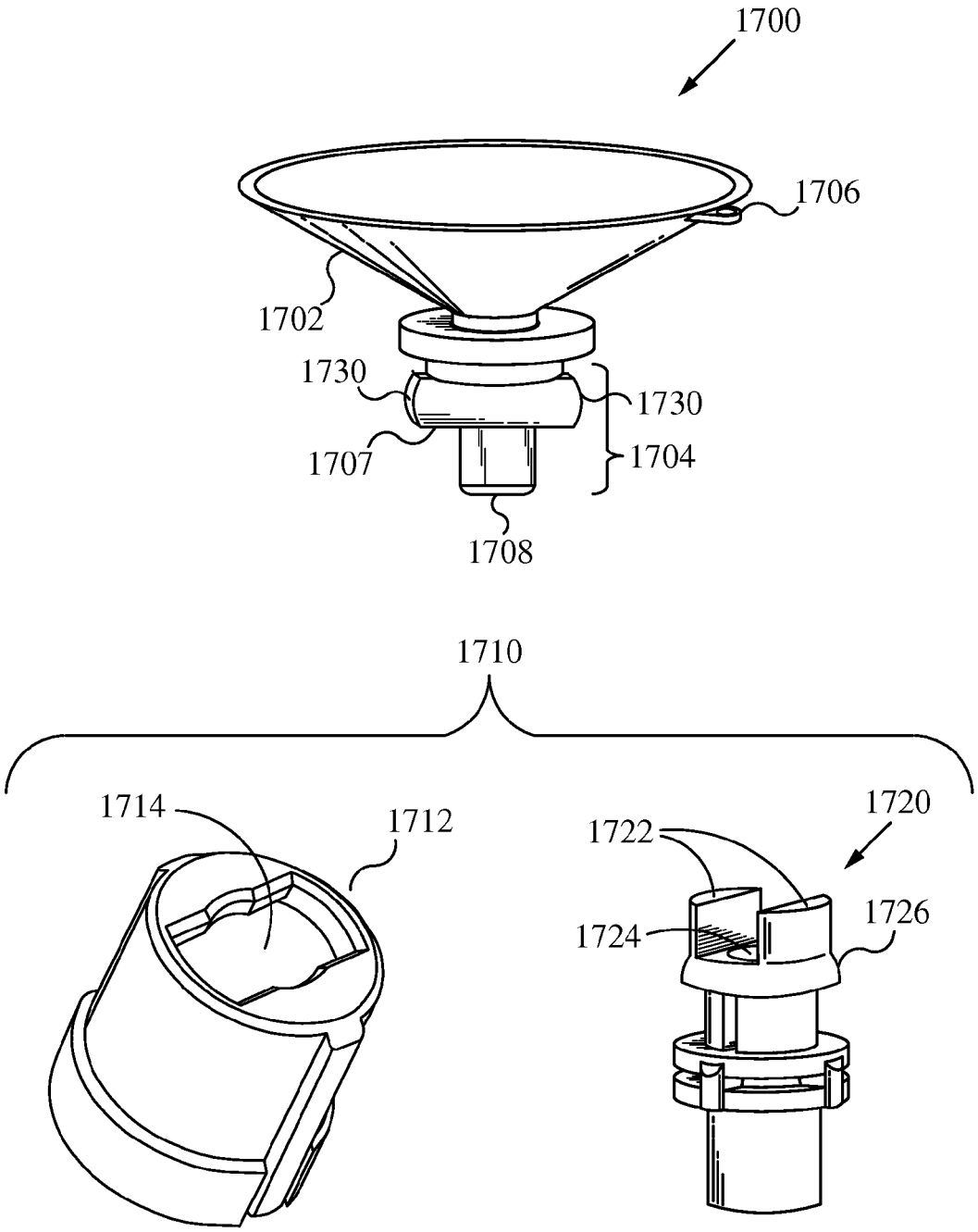
FIG. 19 illustrates a perspective view of an embodiment of the individual components of a light bulb changer, in accordance with the present invention.

FIG. 18 illustrates an embodiment with a suction cup and with an interconnect without the securing member. FIG. 18 shows the protruding member 1704 (FIG. 19) of the holding cup 1702 positioned within the receiving member 1720 of the interconnect 1710. As described above, once the protruding member 1704 (FIG. 19) is positioned within the receiving member 1720, the securing member 1712 (shown in FIG. 17) is positioned to secure the protruding member 1704 (FIG. 19) in place. In some embodiments, the receiving member 1720 comprises a slot or groove between oppositely positioned tabs 1722 configured to receive the protruding member 1704 (FIG. 19) within the slot or groove between the oppositely positioned tabs 1722. In some embodiments, the receiving member 1720 includes an aperture 1724 (FIG. 19) configured for receiving a longitudinal component 1708 (FIG. 19) of the protruding member 1704 (FIG. 19). In some embodiments, the receiving member 1720 comprises a beveled component 1726 for receiving the securing member 1712 (FIG. 19).

FIG. 19 illustrates a perspective view of an embodiment of the individual components of a suction cup light bulb changer 1700. As described above, the suction cup light bulb changer 1700 includes a holding cup 1702, a protruding member 1704 and in some embodiments a protrusion 1706. The holding cup 1702 is sized appropriately to enable a user to install or remove a light bulb, and therefore is able to vary in size depending on the type of light bulb.

In some embodiments, the protruding member 1704 is shaped to fit within an aperture 1714 of the securing member 1712 and to fit within the receiving member 1720. In some embodiments, the protruding member 1704 includes a lateral component 1707 which is of a double-D configuration 1730. The double-D configuration 1730 is such that a backward-facing letter 'D' and a forward-facing letter 'D' are side-by-side as shown. In some embodiments, the protruding member 1704 includes a longitudinal component 1708 configured for insertion into an aperture 1724 of the receiving member 1720. In some embodiments, the protruding member 1704 has other configurations.

The receiving member 1720 is configured to receive the protruding member 1704. In some embodiments, the receiving member 1720 comprises a slot or groove between oppositely positioned tabs 1722 configured to receive the protruding member 1704, and more specifically, the lateral component 1707 of the protruding member 1704, within the slot or groove between the oppositely positioned tabs 1722. In some embodiments, the receiving member 1720 includes an aperture 1724 configured for receiving the longitudinal component 1708 of the protruding member 1704. The receiving member 1720 is also configured to receive with the securing member 1712. In some embodiments the securing member 1712 is configured to fit around the receiving member 1720. In some embodiments, the receiving member 1720 comprises a beveled component 1726 for receiving the securing member 1712.

In some embodiments, the securing member 1712 is configured to fit around the receiving member 1720 and contains an aperture 1714 so that the protruding member 1704 is able to be inserted into the securing member 1712. In some embodiments, the aperture 1714 is shaped in a double-D configuration (as shown) to receive the protruding member 1704. In some embodiments, the securing member 1712 snap-fits on the receiving member 1720. The securing member 1712 is also configured internally so that when positioned in a lock position, the protruding member 1704 is not removable, and when positioned in an unlock position, the protruding member 1704 is removable. In some embodiments, the securing member 1712 contains internal components and spacings such that the internal components secure the protruding member 1704 with the receiving member 1720 and the spacings allow the protruding member 1704 to be removed from the receiving member 1720. In some embodiments, the securing member 1712 only has a lock position.

In some embodiments, the holding cup 1702, the protruding member 1704, the receiving member 1720 and the securing member 1712 comprise a non-electrical conducting material. In some embodiments, the non-electrical conducting material comprises plastic. In some embodiments, the non-electrical conducting material comprises polymer. In some embodiments, the non-electrical conducting material comprises elastomer. In some embodiments, the holding cup 1702, the protruding member 1704, the receiving member 1720 and/or the securing member 1712 comprise a metal.

Figure 20:
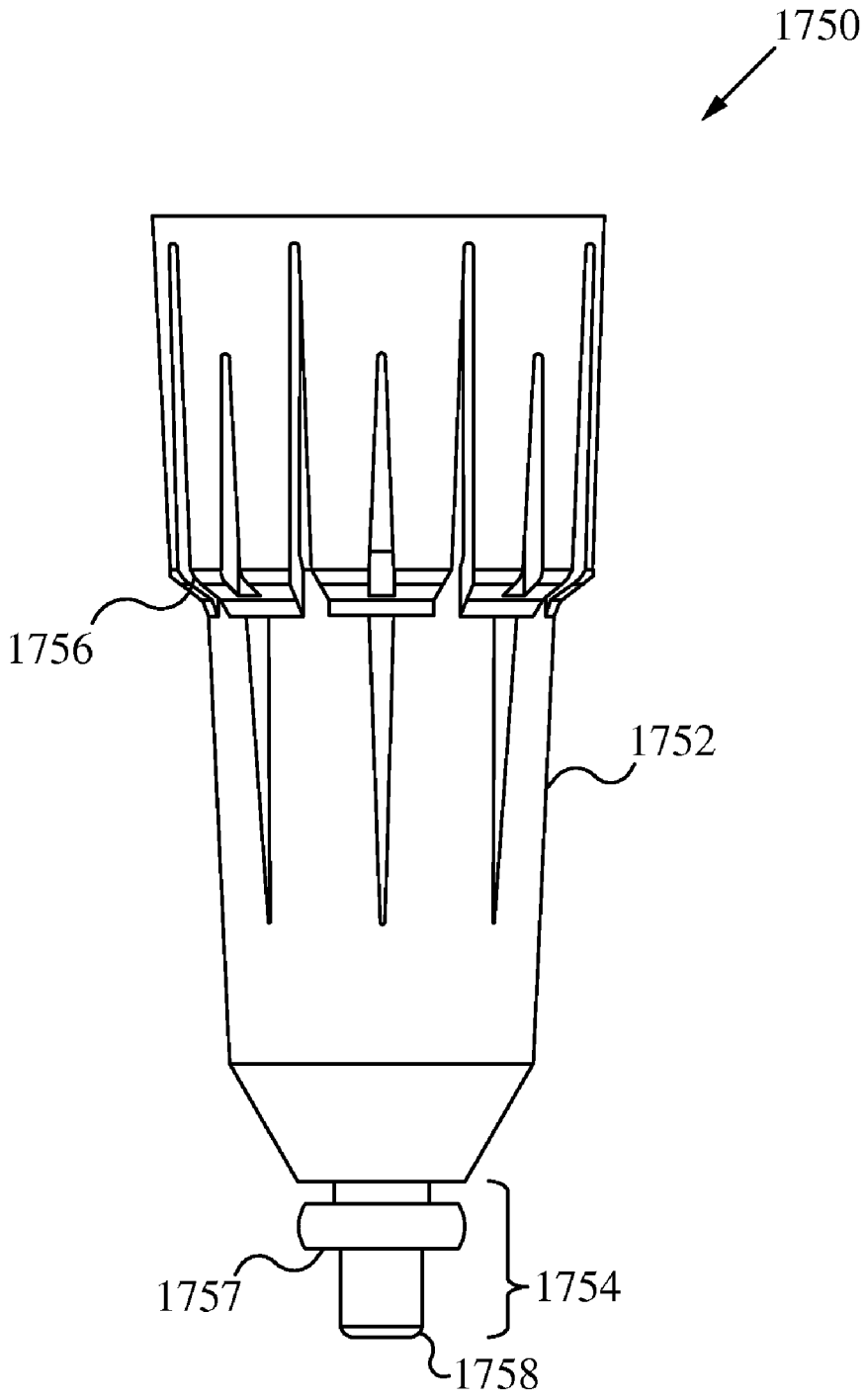
FIG. 20 illustrates an embodiment of a creased grip light bulb changer, in accordance with the present invention.

As shown in FIG. 20, the gripping means does not need to be a suction cup. The gripping means is able to be any light bulb changer such as those described above or any other configuration.

FIG. 20 illustrates an embodiment where the gripping means of the light bulb changer comprises creases. Specifically, a creased grip light bulb changer 1750 illustrated in FIG. 17 comprises a creased gripping means 1752 configured to engage and selectively tighten and loosen a light bulb and a protruding member 1754 coupled to the creased gripping means 1752. In some embodiments, the protruding member 1754 includes a lateral component 1757 and a longitudinal component 1758 for coupling with an interconnect 1710 as described above. In some embodiments of the creased grip light bulb changer 1750, the creased gripping means 1752 and the protruding member 1754 are formed as a single-piece in an integral configuration. In some embodiments, the creased gripping means 1752 and the protruding member 1754 are separate components. Regardless of the embodiment, the protruding member 1754 is further configured to detachably couple to the interconnect 1710 as shown in FIGS. 17 and 18 which is coupled to an arm member 112 (FIG. 1), as described above. The arm member 112 (FIG. 1) is configured for positioning the creased grip light bulb changer 1750 in a desired configuration to engage the light bulb. The creased gripping means 1752 engages the light bulb by slightly expanding around the light bulb as the creased gripping means 1752 is slid on to the light bulb. Once engaged with the light bulb, the creased gripping means 1752 is then turned to either tighten or loosen the light bulb.

Within the creased gripping means 1752 are one or more creases 1756. The one or more creases 1756 enable the creased gripping means 1752 to expand slightly to fit around a light bulb and securely hold the light bulb. While the creased gripping means 1752 is expanded, the material of the creased gripping means 1752 exerts an inward force attempting to return to a relaxed, closed position. This increased force provides a more secure grip on the light bulb than a non-creased gripping means.

The creased gripping means 1752 enables a user to change a light bulb from many angles rather than simply directly below.

In some embodiments, the creased gripping means 1752 and the protruding member 1754 of the creased grip light bulb changer 1750 comprise a non-electrical conducting material. In some embodiments, the non-electrical conducting material comprises plastic. In some embodiments, the non-electrical conducting material comprises polymer. In some embodiments, the non-electrical conducting material comprises elastomer. In some embodiments, the creased gripping means 1752 and the protruding member 1754 of the creased grip light bulb changer 1750 comprise a metal.

The light bulb is selected from the group comprising recessed type, flood light type, reflector type, regular household type, bent tip decorative type, torpedo shape type, beacon lamp type, track head type, candelabra type, globe type, or compact fixture type lightbulb. In another embodiment, the lightbulb comprises a bulbous portion and a narrow portion, wherein the narrow portion is narrower than the bulbous portion. It should be understood that this list only serves to provide examples, and does not serve to limit the type, size, or shape of the lightbulb to be engaged by the creased grip light bulb changer 1750.

In some embodiments, the interconnect 1710 is coupled with a non-motorized arm. For example, a creased grip light bulb changer 1750 is coupled with the interconnect 1710 which is coupled with the non-motorized arm. In another example, a holding cup 1702 is coupled with the interconnect 1710 which is coupled with the non-motorized arm.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

We claim:

1. An interconnect of a light bulb changer comprising:

a. a receiving member comprising a first aperture and a set of tabs, wherein the first aperture and the set of tabs receive a protruding member; and b. a securing member removably coupled utilizing a snap-fit to the receiving member for securing the protruding member within the receiving member.

2. The interconnect of claim 1, wherein the protruding member protrudes from a light bulb gripping mechanism.

3. The interconnect of claim 1, wherein the protruding member is inserted into the receiving member.

4. The interconnect of claim 1, wherein the protruding member further comprises a lateral component and a longitudinal component, further wherein the lateral component is positioned between the set of tabs and the longitudinal component is positioned within the first aperture.

5. The interconnect of claim 1, wherein the securing member further comprises a second aperture for receiving the protruding member and a structure for securing the protruding member with the receiving member.

6. The interconnect of claim 1, wherein the interconnect detachably couples to a holding cup.

7. The interconnect of claim 1, wherein the interconnect detachably couples to an arm member.

8. The interconnect of claim 7, wherein the arm member positions the light bulb changer in a desired configuration to engage a light bulb.

9. The interconnect of claim 7, wherein the arm member is motorized.

10. The interconnect of claim 7, wherein the arm member is non-motorized.

11. The interconnect of claim 2, wherein the light bulb gripping mechanism is utilized with a variety of types of light bulbs wherein the lightbulb is selected from the group comprising recessed type, flood light type, reflector type, regular household type, bent tip decorative type, torpedo shape type, beacon lamp type, track head type, candelabra type, globe type, and compact fixture type lightbulb.

12. The interconnect of claim 2, wherein the light bulb gripping mechanism is a creased gripping member.

13. The interconnect of claim 2, wherein the light bulb gripping mechanism is utilized with a variety of types of light bulbs wherein the lightbulb comprises a bulbous portion and a narrow portion, wherein the narrow portion is narrower than the bulbous portion.

14. The interconnect of claim 1, wherein the interconnect comprises a non-electrical conducting material.

15. The interconnect of claim 1, wherein the interconnect comprises a non-electrical conducting material.

16. The interconnect of claim 15, wherein the non-electrical conducting material comprises one or more of plastic, polymer, and elastomer.

17. A light bulb changer comprising:

a. light bulb gripping mechanism;

b. an interconnect to attach the light bulb gripping mechanism to an arm member, the interconnect comprising a receiving member comprising a first aperture and a set of tabs, wherein the first aperture and the set of tabs receive a protruding member; and c. a securing member for securing the protruding member within the receiving member.

18. The light bulb changer of claim 17, wherein the securing member further includes a second aperture for receiving the protruding member and a structure for securing the protruding member with the receiving member.

19. The light bulb changer of claim 17, wherein the protruding member further comprises a lateral component and a longitudinal component, further wherein the lateral component is positioned between the set of tabs and the longitudinal component is positioned within the first aperture.

20. The light bulb changer of claim 17, wherein the interconnect is detachably coupled to the light bulb gripping mechanism.

21. The light bulb changer of claim 17, wherein the interconnect detachably couples to an arm member.

22. The light bulb changer of claim 17, wherein the arm member positions the light bulb changer in a desired configuration to engage the light bulb.

23. The light bulb changer of claim 17, wherein the arm member is motorized.

24. The light bulb changer of claim 17, wherein the arm member is non-motorized.

25. The light bulb changer of claim 17, wherein the light bulb gripping mechanism is utilized with a variety of types of light bulbs wherein the lightbulb is selected from the group comprising recessed type, flood light type, reflector type, regular household type, bent tip decorative type, torpedo shape type, beacon lamp type, track head type, candelabra type, globe type, and compact fixture type lightbulb.

26. The light bulb changer of claim 17, wherein the light bulb gripping mechanism is utilized with a variety of types of light bulbs wherein the lightbulb comprises a bulbous portion and a narrow portion, wherein the narrow portion is narrower than the bulbous portion.

27. The light bulb changer of claim 17, wherein the light bulb gripping mechanism and the interconnect comprise a non-electrical conducting material.

28. The light bulb changer of claim 27, wherein the non-electrical conducting material comprises one or more of plastic, polymer, and elastomer.

29. A light bulb changer comprising:

a. a creased gripping member to engage and selectively tighten and loosen a light bulb, the creased gripping member comprising a plurality of creases and a protruding member, wherein the plurality of creases expand and retract the creased gripping member;

b. an interconnect to attach the creased gripping member to an arm member, the interconnect comprising a receiving member comprising a first aperture and a set of tabs, wherein the first aperture and the set of tabs receive a protruding member; and c. a securing member for securing the protruding member within the receiving member.

30. The light bulb changing tool of claim 29, wherein the creased gripping member is utilized with a variety of types of light bulbs wherein the lightbulb is selected from the group comprising recessed type, flood light type, reflector type, regular household type, bent tip decorative type, torpedo shape type, beacon lamp type, track head type, candelabra type, globe type, and compact fixture type lightbulb.

31. The light bulb changing tool of claim 29, wherein the creased gripping member and the interconnect comprise a non-electrical conducting material.

32. The light bulb changing tool of claim 29, wherein the arm member is motorized.

33. The light bulb changing tool of claim 29, wherein the arm member is non-motorized.

* * * * *